US006926493B1

(12) United States Patent
Miyamoto et al.

(10) Patent No.: US 6,926,493 B1
(45) Date of Patent: Aug. 9, 2005

(54) TURBO-MOLECULAR PUMP

(75) Inventors: Matsutaro Miyamoto, Chigasaki (JP); Hiroaki Ogamino, Kawasaki (JP); Tetsuma Ikegami, Yokohama-shi (JP); Hiroyuki Kawasaki, Chigasaki (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/473,137

(22) Filed: Dec. 28, 1999

Related U.S. Application Data

(63) Continuation-in-part of application No. 09/104,171, filed on Jun. 25, 1998, now Pat. No. 6,332,752.

(30) Foreign Application Priority Data

| | | |
|---|---|---|
| Jun. 27, 1997 | (JP) | 9/187681 |
| Jan. 27, 1998 | (JP) | 10/29160 |
| Feb. 19, 1999 | (JP) | 11/041039 |
| Jun. 3, 1999 | (JP) | 11/156215 |
| Jul. 14, 1999 | (JP) | 11/200990 |

(51) Int. Cl.[7] ..... F04D 19/04

(52) U.S. Cl. ..... 415/90; 415/9; 415/143; 415/175; 415/177; 415/178

(58) Field of Search ..... 415/90, 143, 175–178, 415/9; 417/423.4

(56) References Cited

U.S. PATENT DOCUMENTS

| | | | | |
|---|---|---|---|---|
| 4,655,678 | A * | 4/1987 | Miki | 415/90 |
| 4,797,062 | A * | 1/1989 | Deters et al. | 415/90 |
| 4,929,151 | A | 5/1990 | Long et al. | |
| 5,536,148 | A * | 7/1996 | Nishiuchi et al. | 415/90 |
| 5,577,883 | A * | 11/1996 | Schutz et al. | 415/60 |
| 5,924,841 | A * | 7/1999 | Okamura et al. | 415/50 |
| 6,135,709 | A * | 10/2000 | Stones | 415/90 |
| 6,332,752 | B2 * | 12/2001 | Ikegami et al. | 415/90 |
| 6,793,466 | B2 * | 9/2004 | Miyamoto | 417/423.4 |
| 2001/0016160 | A1 * | 8/2001 | Ikegami et al. | 415/90 |

FOREIGN PATENT DOCUMENTS

| | | | | |
|---|---|---|---|---|
| DE | 2214702 | | 9/1973 | |
| DE | 3402549 | | 8/1995 | |
| EP | 0 887 556 | | 12/1998 | |
| JP | 4-164187 | A * | 6/1962 | 417/423.4 |
| JP | 59-153988 | A * | 9/1984 | JP |
| 61-25994 | | A * | 2/1986 | 415/90 |

(Continued)

OTHER PUBLICATIONS

Japanese Utility Model Registration No. 2557551 (with English translation).

*Primary Examiner*—Christopher Verdier
(74) *Attorney, Agent, or Firm*—Westerman, Hattori, Daniels & Adrian, LLP

(57) ABSTRACT

A turbo-molecular pump of high safety and reliability was presented, so that if an abnormal condition should develop on the rotor side, it will not lead to any damage to the stationary portions such as the stator or pump casing to cause loss of vacuum in a vacuum processing system. The turbo-molecular pump includes a rotor; a stator assembly surrounding the rotor; and a casing portion surrounding the stator assembly, wherein at least a partial clearance is formed between the stator assembly and the casing portion, so that, when an abnormal torque is applied from the rotor to the stator assembly, direct impact transmission is prevented from the stator assembly to the casing portion.

61 Claims, 34 Drawing Sheets

FOREIGN PATENT DOCUMENTS

| | | | | | |
|---|---|---|---|---|---|
| JP | 62-29796 | A | * | 2/1987 | ..... 415/90 |
| JP | 63-223394 | A | * | 9/1988 | ..... 415/90 |
| JP | 63-266190 | A | * | 11/1988 | ..... 415/90 |
| JP | 3-124998 | A | * | 5/1991 | ..... 417/423.4 |
| JP | 3-290092 | A | * | 12/1991 | ..... 417/423.4 |
| JP | 57-212395 | A | * | 12/1992 | ..... 415/90 |
| JP | 06159287 | A | | 6/1994 | |
| JP | 6-40954 | Y2 | * | 10/1994 | |
| JP | 7-72558 | | | 8/1995 | |
| JP | 08144992 | | | 6/1996 | |
| JP | 09072293 | A | | 3/1997 | |
| JP | 187681/1997 | | | 6/1997 | |
| JP | 09310696 | A | | 12/1997 | |
| JP | 29160/1998 | | | 1/1998 | |
| JP | 10-252684 | | | 9/1998 | |
| JP | 10-274189 | | | 10/1998 | |
| JP | 11-62879 | | | 3/1999 | |

* cited by examiner

TURBO-MOLECULAR PUMP

This is a continuation-in-part of U.S. patent application Ser. No. 09/104,171, filed Jun. 25, 1998, now issued as U.S. Pat. No. 6,332,752.

BACKGROUND OF THE INVENTION

1. Field of the Invention

The present invention relates to a turbo-molecular pump for evacuating gas by using a high speed rotor.

2. Description of the Related Art

An example of a conventional turbo-molecular pump is shown in FIG. 37. The turbo-molecular pump is comprised by a cylindrical pump casing 14 housing a vane pumping section $L_1$ and a groove pumping section $L_2$ which are constituted by a rotor (rotation member) R and a stator (stationary member) S. The bottom portion of pump casing 14 is covered by a base section 15 which is provided with an exhaust port 15*a*. The top portion of pump casing 14 is provided with a flange section 14*a* for coupling the pump to an apparatus or a piping to be evacuated. Stator S comprises a stator cylinder section 16 provided upright at the center of the base section 15, fixed sections of vane pumping section $L_1$ and groove pumping section $L_2$.

Rotor R is comprised by a rotor cylinder section 12 attached to a main shaft 10 which is inserted into stator cylinder section 16. Between main shaft 10 and stator cylinder section 16 are constituted a drive motor 18, an upper radial bearing 20 and a lower radial bearing 22 disposed on the upper and lower sides of drive motor 18 respectively. Under main shaft 10, there is an axial bearing 24 having a target disk 24*a* at the bottom end of main shaft 10 and an upper and a lower electromagnets 24*b* on the stator S side. In this configuration, a high speed rotation of rotor R is supported under a five coordinate active control system.

Rotor vanes 30 are provided integrally with the upper external surface of rotor cylinder section 12 to form an impeller, and on the inside of pump casing 14, stator vanes 32 are provided in such a way to alternately interweave with rotor vanes 30. These vane members constitute vane pumping section $L_1$ which carries out gas evacuation by cooperative action of the high speed rotor vanes 30 and stationary stator vanes 32. Below vane pumping section $L_1$, groove pumping section $L_2$ is provided. Groove pumping section $L_2$ is comprised by a spiral groove section 34 having spiral grooves 34*a* on the outer surface of the bottom end of rotor cylinder section 12, and stator S comprises a spiral groove section spacer 36 surrounding spiral groove section 34. Gas evacuation action of groove pumping section $L_2$ is due to the dragging effect of spiral grooves 34*a* of spiral groove section against gases.

By providing groove pumping section $L_2$ at downstream of vane pumping section $L_1$, a wide-range turbo-molecular pump can be constructed so as to enable evacuation over a wide range of gas flow rates using one pumping unit. In this example, the spiral grooves of groove pumping section $L_2$ are provided on the rotor side of the pump structure, but some pumps have the spiral grooves formed on the stator side of the pump structure.

Such turbo-molecular pumps are assembled as follows. Firstly, groove pumping section spacer 36 is attached by coupling the lower surface of step 36*a* to protruded ring section 15*b* formed on base section 15. Next, rotor R is fixed in some position, and stator vanes 32, which are normally split into two half sections, are clamped around to interweave between rotor vanes 30. This is followed by placing a stator vane spacer 38, having steps on its top and bottom regions, on top of the clamped rotor vane 30. This assembling step is repeated for each rotor vane 30 to complete the assembly of stator vanes 32 around rotor R.

Lastly, pump casing 14 is attached by sliding it around the layered stator vane structure and fixing flange 14*b* to the base 15 of stator S by fasteners such as bolts, thereby pressing the top stator vane spacer 38 firmly against stepped surface 14*c* on the inside surface of pump casing 14 and binding the entire layered assembly and groove pumping section spacer 36. It can be understood from this assembly structure that the peripheries of each of stator vanes 32 are pressed together by stator vane spacers 38 located above and below, and similarly groove pumping section spacer 36 is pressed down by the lowermost stator vane 32, stator vane spacer 38 and protrusion section 15*b* of base section 15, so that the axially applied pressing force prevents induced rotation of stator vanes 32 and groove pumping section spacer 36 with rotor R in the circumferential direction.

Also, though not shown in the drawing, in order to ensure to fix the groove pumping section spacer 36 to the stator cylinder section 16 of the stator S, sometimes groove pumping section spacer 36 is fastened to stator cylinder section 16 of stator S by bolts to assure such fixation.

SUMMARY OF THE INVENTION

In such turbo-molecular pumps, abnormal rotation caused by eccentricity of rotor R may sometimes occur, and they may be accompanied by damaging of rotor R itself, especially rotor cylinder section and rotor vanes 30. In such a case, the stator structure can also be subjected to significant circumferential or radial force by rotor R and its fragment, which may impact on not only stator vanes 32 but stator vane spacers 38 and groove pumping section spacer 36.

Such abnormal force can cause not only deformation of stator vanes 32 and spacers 36, 38, but can cause fracture of pump casing 14 and stator cylinder section 16, or damage to their joints or severing of vacuum connections attached to the pump. Such damage and severing to any parts of stator S cause breakage of vacuum in the whole processing system connected to and evacuated by the pump not only to damage the system facilities and in-process goods, but also to lead to accidental release of gases in the system to outside environment.

It is an object of the present invention to provide a turbo-molecular pump of high safety and reliability so that if an abnormal condition should develop on the rotor side, it will not lead to damage to the stator or pump casing to cause loss of vacuum in a vacuum processing system.

The present invention is a turbo-molecular pump comprising: a rotor; a stator assembly surrounding the rotor; and a casing portion surrounding the stator assembly, wherein at least a partial clearance is formed between the stator assembly and the casing portion, so that, when an abnormal torque is applied from the rotor to the stator assembly, direct impact transmission is prevented from the stator assembly to the casing portion. Accordingly, when an abnormal torque is transmitted to the stator assembly due to some abnormal condition developing in the rotor side, the direct transmission of the impact from the stator assembly to the casing portion is prevented so that damage to casing portion itself and the vacuum connections to the exterior devices can be avoided. The casing portion means the portion constructing an outer envelope for the turbo molecular pump including the above-mentioned pump casing 14 or base section 15.

The turbo-molecular pump may further comprise a reinforcing member for reinforcing the stator assembly. This is because it is preferable to compensate the lowered strength of the stator assembly due to formation of the clearance between the stator assembly and the casing portion. The reinforcing member may be a cylindrical member arranged between the stator assembly and the casing portion. Also, the reinforcing member may be made to combine the elements constituting the stator assembly.

The stator assembly may comprise a stacked configuration for fixing the stator vanes in a vane pumping section, and the reinforcing member may be axially aligned to penetrate the stacked configuration. The reinforcing member may be made of a material capable of absorbing impact generated by abnormal torque through its deformation or fracture. The reinforcing member may be comprised of a hollow pipe.

The turbo-molecular pump may further comprise a slide facilitating member for facilitating the stator assembly to slide in a circumferential direction relative to the casing portion. Accordingly, the slide facilitating member facilitates the stator assembly to rotate when an abnormal torque is applied from the rotor to the stator, and to absorb the impact energy thereby to prevent transmission of torque to the casing portion, so as to prevent the breakage of the stator assembly and its connections with the exterior devices. The slide facilitating member may be a low friction member provided between the stator assembly and the casing portion. The slide facilitating member may be a support structure for rotatably supporting the stator assembly.

An impact absorbing member may be provided between the stator assembly and the casing portion. The stator assembly may have a multiple structure. The turbo-molecular pump may further comprise a temperature adjusting mechanism for directly or indirectly heating or cooling the stator assembly.

Another aspect of the present invention is a turbo-molecular pump comprising: a casing portion housing a stator and a rotor therein; and a vane pumping section and/or a groove pumping section comprised by the stator and the rotor, wherein an impact absorbing structure is provided in at least a part of the stator, the impact absorbing structure being arranged to cooperatively work or interlockingly move with the rotor to absorb impact loaded on the stator when abnormal torque is applied from the rotor to the stator.

Accordingly, when an abnormal torque is transmitted to the stator assembly due to some abnormal condition developing in the rotor side, the impact absorbing structure cooperatively works with the rotor to absorb the rotational energy of the rotor, as well as to prevent transmission of torque to the casing portion, so as to prevent the breakage of the casing portion and its connections with the exterior devices.

The impact absorbing structure may comprise an inner casing surrounding the vane pumping section and/or a groove pumping section. The inner casing prevents the fragments of the rotor from scattering when the pump is in an abnormal operation, and also absorbs the impact energy by deforming itself thereby to act to minimize the affect on the casing portion.

A clearance may be provided between the inner casing and the casing portion. This facilitates the inner casing to smoothly rotate while preventing it from hard contacting with the casing portion, when an abnormal torque is transmitted from the rotor to the stator due to some abnormal condition developing in the rotor, thus absorbing the rotating energy of the rotor. Even when the inner casing somewhat deforms, torque transmission to the casing portion is prevented to avoid the breakage of the casing portion or its connections with the exterior.

The inner casing may be fixed by fitting a part of an inner surface or an outer surface of the inner casing to a cylindrical portion of the stator or to the casing portion. Thus, when an abnormal torque is transmitted from the rotor to the stator due to some abnormal condition developing in the rotor, the inner casing rotates by being guided by the cylindrical portion of the stator or to the casing portion thereby suppressing transmission of a large rotational torque to the casing portion.

The impact absorbing structure may comprise a friction reducing mechanism intervening between the inner casing and the stator or the casing portion. This facilitates rotation of the inner casing so as to prevent the impact due to rotor fracture from being transmitted to the casing portion.

As for such impact absorbing structure, not only an inherent low friction material such as tetrafluoroethylene polymer, but mechanical bearings such as a ball bearing or a roller bearing can be used. Accordingly, when an abnormal torque is developed by an abnormal situation in the rotor, the bearing in the impact absorbing structure cooperatively rotates with the rotor to absorb the rotational energy of the rotor thereby to prevent a large rotational torque from being further transmitted to the casing portion.

The mechanical bearing can be located in a groove pumping section which includes a large space between the casing portion and outside of the rotor, so that the impact absorbing structure can be assembled without increasing the overall dimension of the turbo-molecular pump. Also, when using more than two bearings, it is preferable, for the purpose of enhancing supporting ability for the inner casing against loaded impact thereon, to locate one of them close to intake port of vane pumping section, and the other close to exhaust port of the spiral groove pumping section, thereby providing a wide axial distance therebetween.

The impact absorbing structure may comprise an impact absorbing member provided between the stator in the vane pumping section and/or groove pumping section and the inner casing. Accordingly, the member can absorb and moderate the radial and circumferential impact forces due to collision of the fractured rotor fragments, so as to prevent deformation of the inner casing or damaging of supporting structures for the inner casing, thus reducing the impact force transmission to the casing portion.

The impact absorbing structure may be formed as a connected structure of inner and outer portions respectively located in- and outside the rotor. Since the fragments of the fractured rotor are scattered outwardly to collide with the outer portion outside the impact absorbing structure thereby to deform it, thus the large impact force and rotational torque is reduced. On the other hand, the fragments scarcely collide with the inner portion inside the rotor, so it does not deform and maintains its original shape. Therefore, the impact absorbing structure can be rotated as a whole by being guided by the inner portion, thereby enabling to prevent large impact force and rotational torque from being transmitted to the casing portion.

The impact absorbing structure may be provided at the upstream of vane pumping section, so that it is located where it is not affected by scattering fragments of the rotor. Although the upstream area of vane pumping section basically does not need the rotor, it is preferable to extend the rotor to the upstream side as necessary. In this case, it is necessary to assure a sufficient flow passage area in order not to interfere the pumping operation itself.

In the impact absorbing structure, a sealing section may be provided in at least a part of a neighboring space with the casing portion or stator. Accordingly, it is possible to prevent generation of reverse flow flowing from discharge side to intake side in the impact absorbing structure which does not perform any pumping action. The sealing section also serves to protect the mechanical bearing from corrosive gases or by-product materials.

The inner casing and/or the casing portion may be comprised by a high thermal conductivity material. When the pump comprises double casings, the space between the inner and outer casings puts the inner casing in a vacuum and thermally isolated state. Thus, the generated heat within the vacuum pump (heat generated through gas agitation by the rotor or heat generated in the motor) cannot be released to the exterior effectively, resulting in raising of inner temperatures and narrowing of operation ranges of the pump for gas flow rate and pressure. By constructing the inner casing and/or casing portion by a high thermal conductivity material (aluminum alloys or copper alloys), dissipation of the heat inside the pump can be effectively performed to expand the operation range of the pump. It is also permissible to enhance the heat transfer between the inner casing and casing portion, by providing a high thermal conductivity heat transfer member therebetween, or by putting the inner casing and casing portion in a close contact at least partially.

The turbo-molecular pump may further comprise a temperature adjusting mechanism for directly or indirectly heating or cooling the inner casing. By providing a heater or a cooling water pipe to the inner casing, it is possible to provide a local temperature control for raising or cooling the temperature at desired location of the pump. It can prevent generation of by-product material within the pump during specific processes and expands the operational range of the pump.

The vane pumping section may comprise a stacked configuration for fixing the stator vanes of the vane pumping section, and the impact absorbing structure may comprise a bar member axially penetrating the vane pumping section and capable of absorbing an impact generated by abnormal torque through its self deformation or by fracturing. Accordingly, in the normal operation, the bar member maintains rigidity of the apparatus, and when the abnormal torque due to abnormal situation in the rotor is transmitted to the stator vanes, it deforms to allow the stator assembly to deform in a shearing direction, and concurrently absorbs the impact energy through its deformation. Thus, the bar member prevents the transmission of abnormal torque to the casing portion to avoid the fracture of the casing portion and its connections with exterior devices.

The vane pumping section may comprise a multiple structure. Accordingly, by constructing the vane pumping section at least partially as a multiple structure, it is possible to enhance its rigidity and impact absorbing ability.

The bar member may comprise a hollow pipe. Accordingly, it is possible to reduce weight while maintaining its rigidity and energy absorbing characteristics required for the bar member.

The stator assembly may be attached to the casing portion by way of a friction reducing mechanism. The turbo-molecular pump may further comprise a temperature adjusting mechanism for directly or indirectly heating or cooling the stator portion in the vane pumping section and/or the groove pumping section.

In another aspect of the present invention, a turbo-molecular pump may comprise: a rotor; a stator assembly surrounding the rotor; a casing portion surrounding the stator assembly; and a constriction releasing structure for releasing constriction of the stator assembly when an abnormal torque is applied to the stator assembly from the rotor. Accordingly, since the stator assembly can slide easily within the casing portion, the impact transmitted to the stator assembly is prevented from being transmitted directly to the casing portion, and the energy is absorbed in a sliding process.

In another aspect of the present invention, a turbo-molecular pump may comprise: a rotor; a stator assembly surrounding the rotor; a casing portion surrounding the stator assembly; and an impact absorbing structure for absorbing impact transmitted to the stator assembly when an abnormal torque is applied to the stator assembly from the rotor. Accordingly, the impact transmitted to the stator assembly is prevented from being transmitted directly to the casing portion, and the energy is absorbed by the impact absorbing structure.

In another aspect of the present invention, turbo-molecular pump may comprise: a rotor; a stator assembly surrounding the rotor; a casing portion surrounding the stator assembly; and a reinforcing member for reinforcing the stator assembly. Accordingly, the stator assembly is reinforced and equipped with sufficient strength and energy absorbing ability.

In another aspect of the present invention, turbo-molecular pump may comprise: a rotor; a stator assembly surrounding the rotor; a casing portion surrounding the stator assembly; and a rotation facilitating structure for facilitating rotation of the stator assembly relative to the casing portion when an abnormal torque is applied to the stator assembly from the rotor. Accordingly, since the stator assembly can slide easily within the casing portion, the impact transmitted to the stator assembly is prevented from being transmitted directly to the casing portion, and the energy is absorbed in a sliding process. The rotation facilitating structure may be comprised by a low friction member provided between the stator assembly and casing portion, or a supporting mechanism rotatably supporting the stator assembly.

DESCRIPTION OF THE PREFERRED EMBODIMENTS

Figure 1:
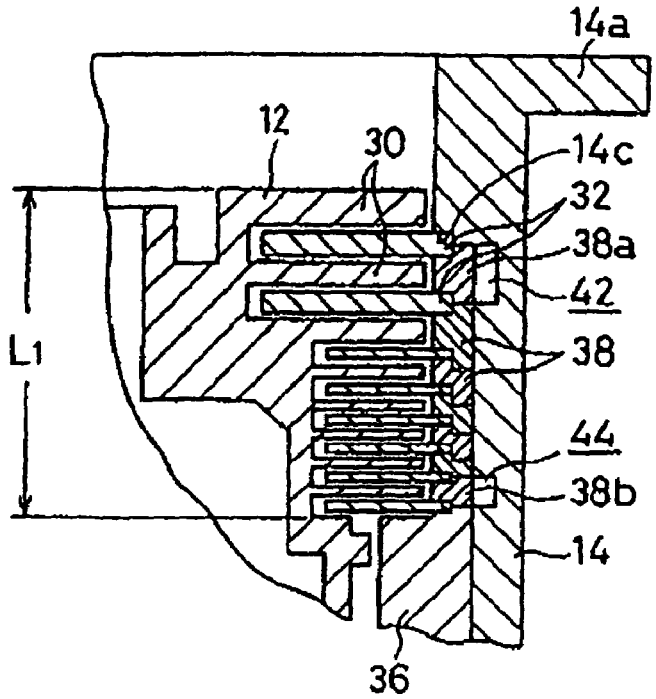
FIG. 1 is a cross sectional view of a turbo-molecular pump of a first embodiment according to the present invention.
Figure 2:
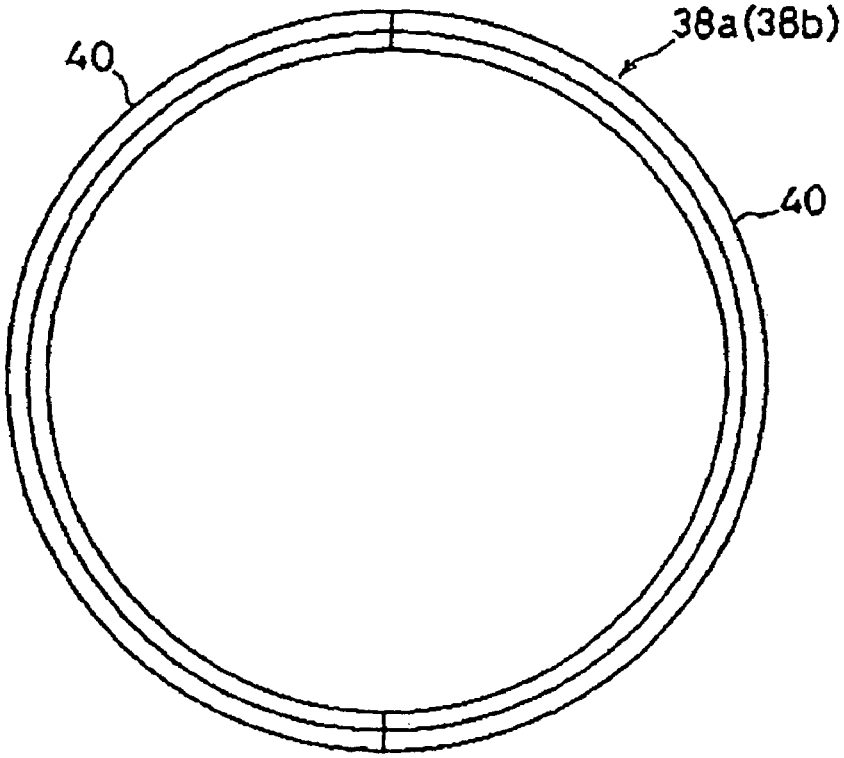
FIG. 2 is a plan view of a stator vane spacer used in the uppermost stage and the lowermost stage of the vane pumping section shown in FIG. 1.

In the following, preferred embodiments will be presented with reference to the drawings. FIGS. 1 and 2 relate to the first embodiment of the turbo-molecular pump. The present pump shares some common structural features with the conventional pump shown in FIG. 37, such as vane pumping section $L_1$ comprised by alternating rotor vanes 30 and stator vanes 32, groove pumping section $L_2$ having spiral groove section 34 and groove pumping section spacer 36. As well, pump casing 14 is used to press down stator vanes 32, stator vane spacers 38 and groove pumping section spacer 36. Therefore, an overall illustration of this embodiment is omitted.

The present pump is constructed so that, when abnormal torque is applied to the stator vane 32 due to abnormal conditions developing in any rotor components, a part of stator vane spacers 38 is able to move radially outward. This is achieved by having the uppermost vane spacer 38*a* and the lowermost vane spacer 38*b* each of which is comprised by vane spacer halves 40. The inner surface of pump casing 14 has grooves 42, 44 extending all around its circumference at corresponding heights with that of the outer surfaces of the uppermost and lowermost vane spacers 38*a*, 38*b*. The width of grooves 42, 44 is slightly larger than the thickness of stator vane spacers 38*a*, 38*b*.

During the normal operation of such a pump, no large torque will be applied to either stator vanes 32 or stator vane spacers 38 in the circumferential or radial direction, and the assembly, consisting of stator vanes 32 and stator vane spacers 38, retain their positions because of mutual friction therebetween. Stator vane spacers 38*a*, 38*b* retain their ring shape, and hold individual stator vanes 32 in contact with the associated stator vane spacers 38.

If an abnormal condition should develop in the rotation of rotor R or if rotor R should break for whatever reason, and either or both of stator vane spacers 38*a*, 38*b* are subjected to a large force acting in circumferential or radial direction, both or either one of stator vane spacers 38*a*, 38*b* are pushed outwards, and the upper and lower half spacers 40 are separated to respectively enter into grooves 42, 44. In this condition, other stator vane spacers 38 become loose and rotatable because of the release of constrict in an axial direction. This causes stator vanes 32 and stator vane spacers 38 to be dragged with rotor R, and causes the rotation energy of rotor R to be gradually dissipated, and rotor R eventually stops. Because of the release of an axial constrict of stator vanes 32 and stator vane spacers 38 against pump casing 14, torque of rotor R is no longer transmitted to pump casing 14, so that damage to pump casing 14 or to connection to external facility is not produced.

In the embodiment presented above, the uppermost and the lowermost stator vane spacers 38*a*, 38*b* are made into split rings, but either one of the split type spacer is enough for the purpose of invention, and also, any one or more of spacers 38 disposed in the mid-section of rotor R can be selected as the split type spacer. It is also possible to split the spacers into two or more pieces.

Figure 3:
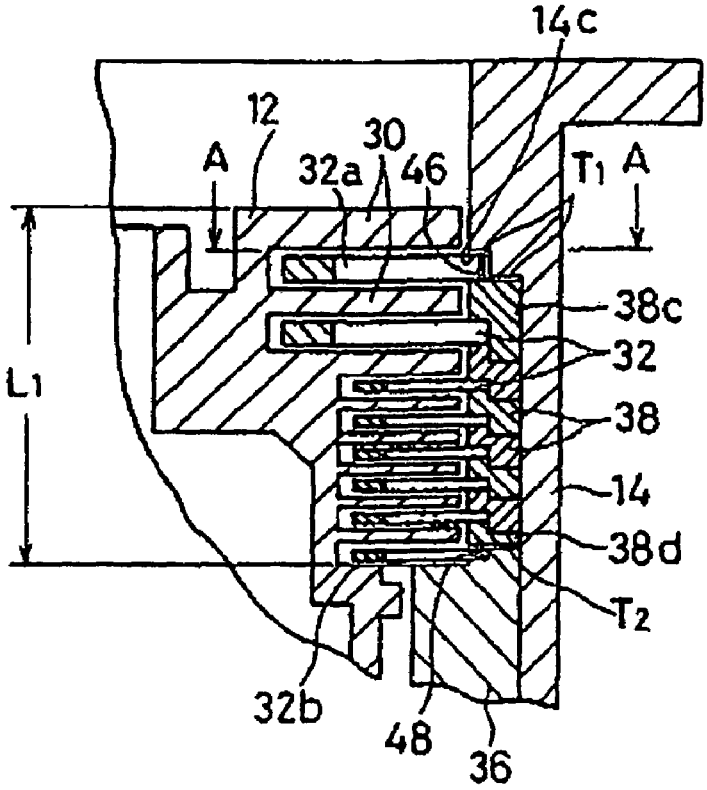
FIG. 3 is a cross sectional view of a turbo-molecular pump of a second embodiment according to the present invention.
Figure 4:
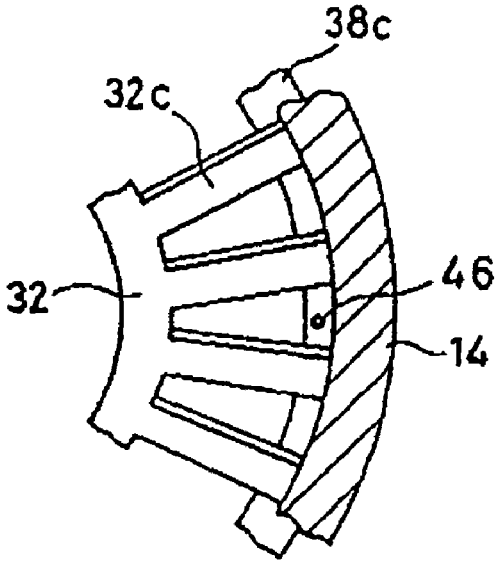
FIG. 4 is a cross sectional view through a plane A—A in FIG. 3.

FIGS. 3 and 4 show a second embodiment of the turbo-molecular pump according to the invention. This pump is also constructed so that the axial constrict of stator vane 32 is released at an early stage of the onset of abnormal condition. As shown in FIG. 4, a plurality of support pins 46 are provided equally spaced in the circumferential direction in a space between the vanes 32*c* of the uppermost stator vane 32*a*. Similar support pins 48 are also provided in a space between vanes 32*b* of the lowermost stator vanes 32.

With reference to FIG. 3, support pins 46 are fitted between step surface 14*c* of pump casing 14 and the uppermost stator vane spacer 38*c* as a "support rod". The length of the pins is chosen to be slightly greater than the thickness of the uppermost stator vane 32*a*. Similarly support pin 48 is fitted between groove pumping section spacer 36 and the lowermost stator vane spacer 38*d* and its length is made slightly larger than the thickness of the lowermost stator vane 32*b*. Therefore, a clearance $T_1$ is formed between the uppermost stator vane 32*a* and step surface 14*c* and a clearance $T_2$ is formed between the lowermost stator vane spacer 38*d* and the lowermost stator vane 32*b*.

These support pins 46, 48 are made in such a way that, during normal operation of the pump, they are sufficient in their strength and number to support stator vane spacer 38 in place, and if some abnormal condition should develop, such as twist of rotor R or torque on stator S by rotor R, then the pins can be readily broken. Also, the sizes of the clearance $T_1$, $T_2$ are chosen to be in a range of about 50~100 $\mu$m, for example, such that, during normal operation, stator vanes 32*a* do not experience any slack.

Such a pump operates as follows. During normal operation, the pump will remain in the condition illustrated in FIG. 3, but if rotor R should break or experience abnormal rotation to cause some twist or torque to be developed between stator S and rotor R, support pins 46, 48 will either fall down or break. This causes clearances $T_1$, $T_2$ to be spread among stator vanes 32 and stator vane spacers 38, thereby the assembly becomes loose and releases the axial constricting force which had been exerted on the assembly. The result is that stator vane spacers 38 become rotatable with the impeller, and reduces the chances of torque being transmitted to the casing components 14, thereby preventing damage to the pump. Although top and bottom pins 46, 48 are provided in this embodiment, it is permissible to provide such pins at either end of vane pumping section $L_1$.

Figure 5:
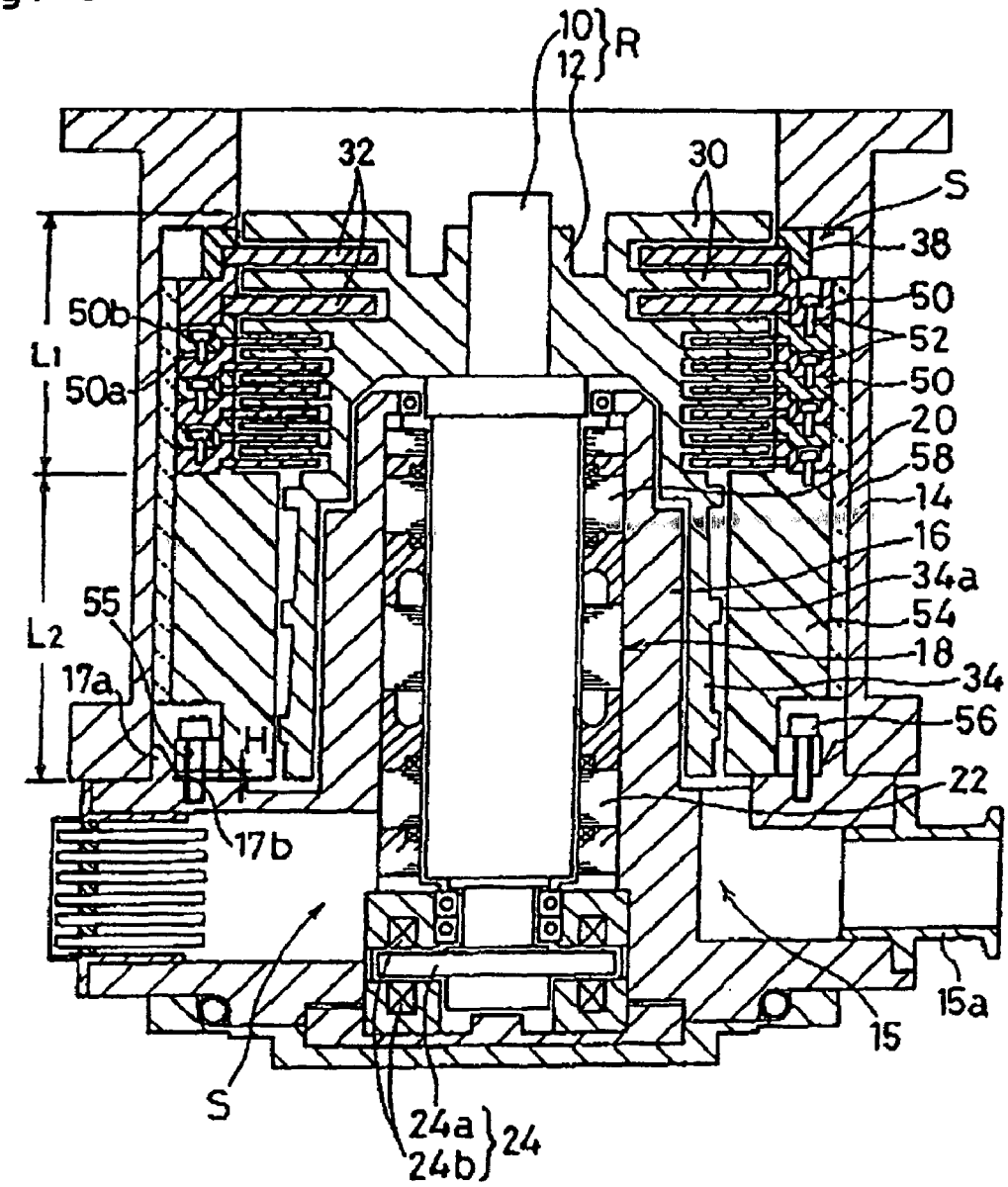
FIG. 5 is a cross sectional view of a turbo-molecular pump of a third embodiment according to the present invention.
Figure 6:
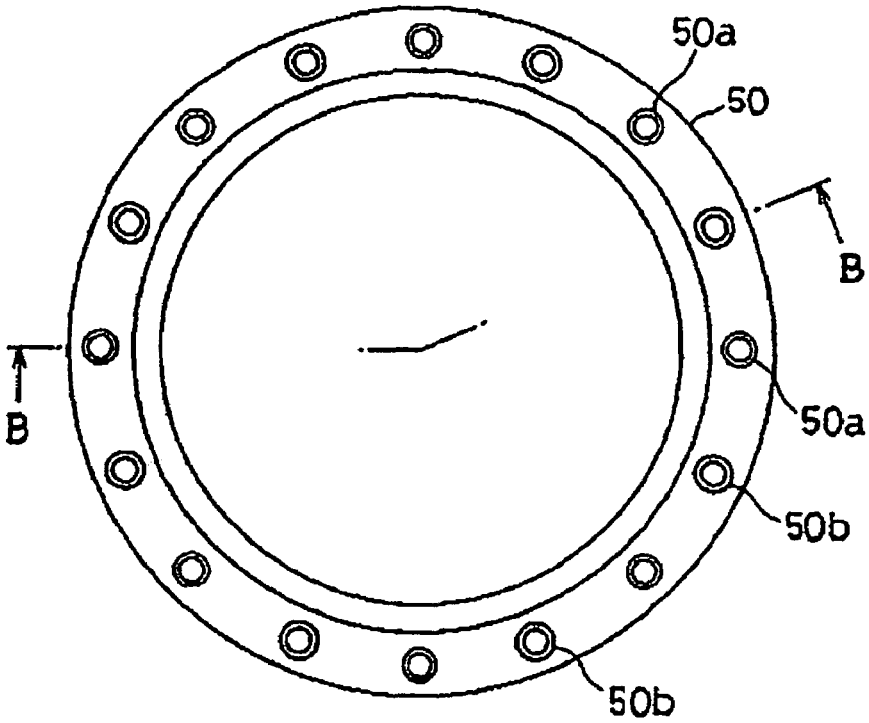
FIG. 6 is a plan view of a stator vane spacer shown in FIG. 5.
Figure 7:
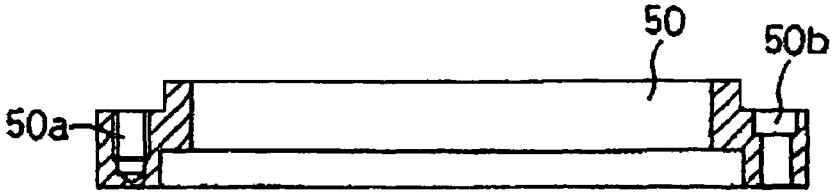
FIG. 7 is a cross sectional view through a plane B—B in FIG. 6.

FIGS. 5 to 7 show a third embodiment of the turbo-molecular pump according to the invention. In this pump, as shown in FIGS. 6 and 7, all stator vane spacers 50, excepting the uppermost stator vane spacer, are provided with a series of threaded holes 50*a* and bolt holes 50*b* alternately distributed on the periphery in a circumferential direction so that a bolt (shear bolt) 52 can be inserted through a bolt hole 50*b* of an upper stator vane spacer 50 to be fastened into a threaded holes 50*a* of a lower stator vane spacer 50 so as to assemble all stator vane spacers 50 to each other. The lowermost stator vane spacer 50 is fixed to the top of the groove pumping section spacer 54 also by bolts 52.

The strength of bolts 52 is selected such that, when abnormal torque is transmitted to spacer 50 due to breaking of rotor R or abnormal rotation, they will fracture. The bolt strength is determined either by selecting the material or diameter, or by providing a rupture inducing portion such as a notch on bolts 52.

Groove pumping section spacer 54 in groove pumping section $L_2$ is fixed to base section 15 of stators by inserting bolt (shear bolt) 56 through a bolt receiving slit 55 and screwing bolt 56 into base section 15. The strength of bolt 56 is selected so that it will break when torque of a certain magnitude is transmitted to spacer 54.

Figure 37:
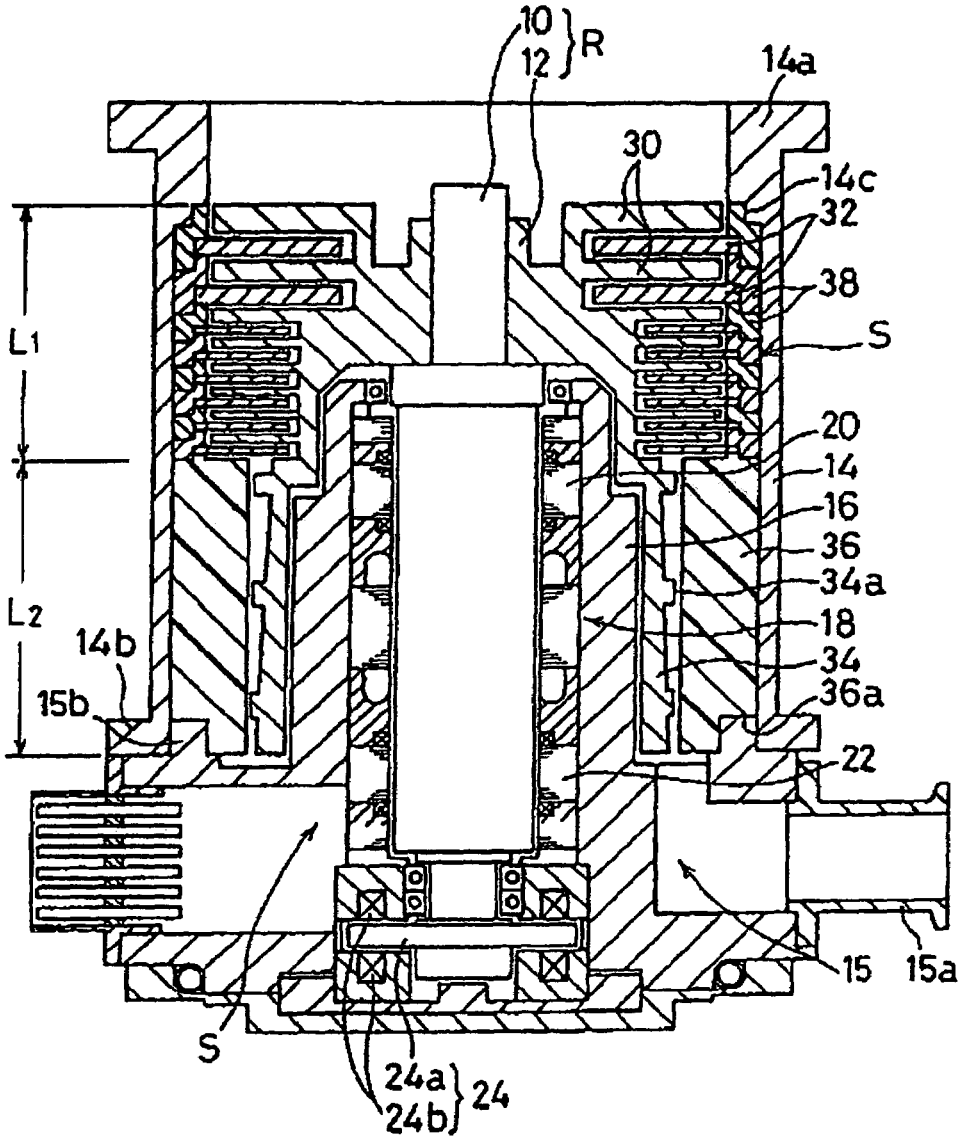
FIG. 37 is a cross sectional view of a conventional turbo-molecular pump.

In this embodiment, the inside corners of protrusion 17*a* which supports the bottom end of groove pumping section spacer 54 are chamfered, and height H of contact surface 17*b* contacting the bottom end of groove pumping section spacer 54 is made shorter than the case shown in FIG. 37. Also, a friction reducing device is provided in the form of a cylinder-shaped low-friction sleeve 58 which is made of a low friction material disposed in the space formed between spacers 50, 54 and pump casing 14.

Such a pump operates as follows. When abnormal torque acts on stator vane spacers 50 or groove pumping section spacer 54, bolts 52, 56 fastening stator vane spacers 50 and groove pumping section spacer 54 to stator S are fractured, thus releasing the axial compression to enable the stationary members to rotate with the impeller. This causes the energy of rotor R to be dissipated, and lowers the torque transmitted from rotor R to stator S, thus preventing damage to stator S.

Also, because friction reducing devices 58 is provided in the space between pump casing 14 and stator vane spacers 50/groove pumping section spacer 54, frictional force resulting between pump casing 14 and stator vane spacers 50/groove pumping section spacer 54 after bolts 52, 56 are ruptured is reduced. Also, because the contact area between base section 15 and groove pumping section spacer 54 is made small, the force transmitted to stator S is further reduced. The purpose of providing a circumferential groove 42 opposite the outer edge of the uppermost stator vane spacer 38 has been explained in the first embodiment.

Figure 8:
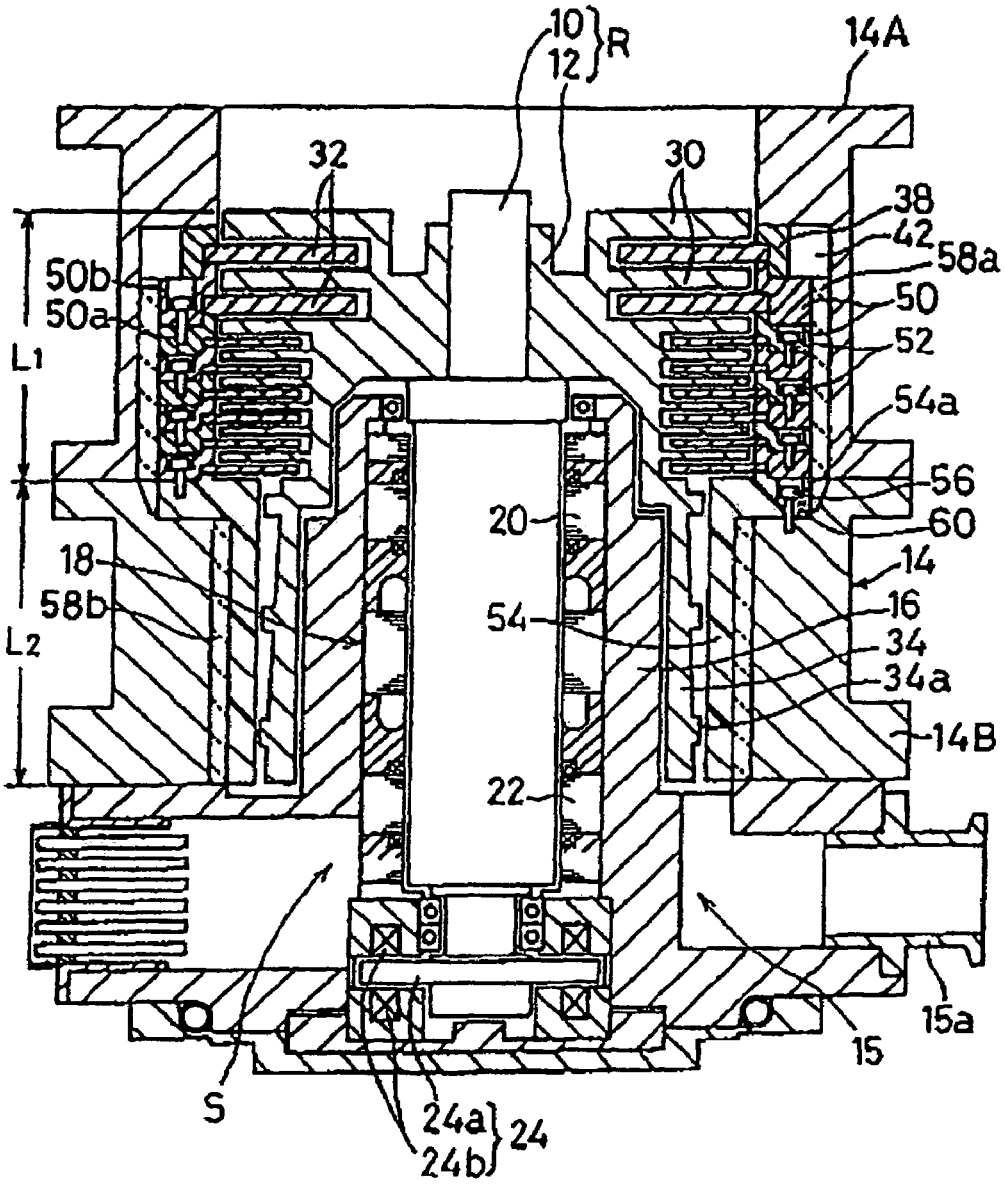
FIG. 8 is a cross sectional view of a turbo-molecular pump of a fourth embodiment according to the present invention.

FIG. 8 shows a fourth embodiment of the pump according to the invention. Pump casing 14 in this case is made of an intake-side pump casing 14A and an exhaust-side pump casing 14B, which are attached to form a complete pump casing 14. Stator vane spacers 50 in vane pumping section $L_1$ are axially fixed layer by layer by using bolts 52 as in the previous embodiment.

The exhaust side pump casing 14B has a step surface 60 at the top end, and groove pumping section spacer 54 has a flange section 54*a*, so that groove pumping section spacer 54 is attached to the exhaust-side pump casing 14B by fastening step surface 60 to flange section 54*a* by bolts 56. The strength of bolts 56 is selected such that they will break at a given torque. In this embodiment also, cylinder-shaped friction reducing sleeves (friction reducing structure) 58*a*, 58*b* are provided in the spaces between stator vanes 50 and the intake-side pump casing 14A on the one hand, and groove pumping section spacer 54 and the exhaust-side pump casing 14B. The turbo-molecular pump of this embodiment provides the same protective effects described above.

Figure 9:
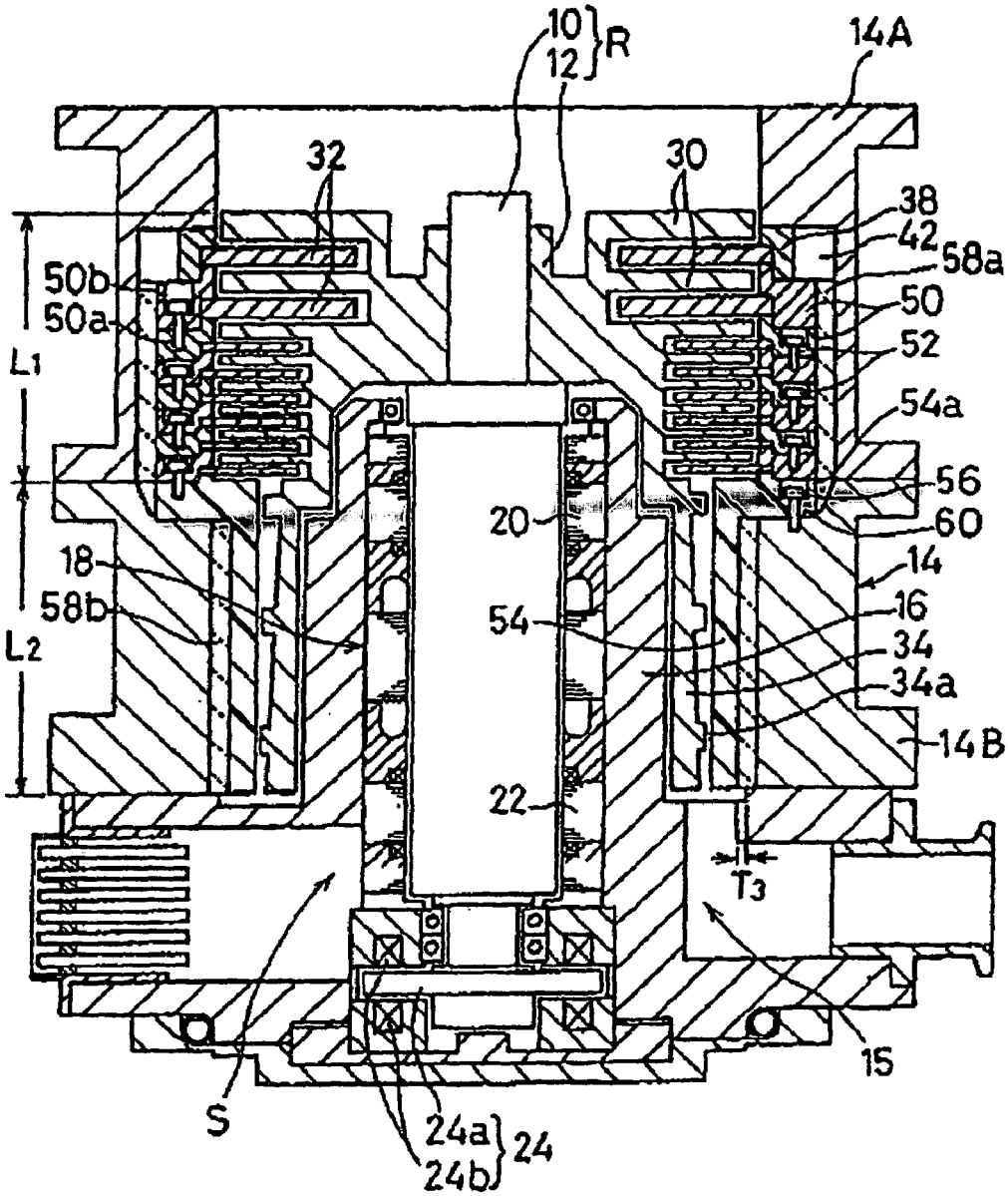
FIG. 9 is a cross sectional view of a variation of the pump shown in FIG. 8.

FIG. 9 shows a variation of the fourth embodiment shown in FIG. 8. Groove pumping section spacer 54 in the groove pumping section stator of this pump is attached by bolting top flange section 54*a* to step surface 60 at the top end of the exhaust-side pump casing 14B as in the previous embodiment. Friction reducing sleeves (friction reducing structure) 58*a*, 58*b* are provided in the spaces formed in the intake-side pump casing 14A and likewise in the exhaust-side pump casing 14B. In the previous embodiment, the bottom end of groove pumping section spacer 54 contacted the inside surface of base section 15 to produce the circumferential constricting force, but in this embodiment, there is a clearance $T_3$ between the outer periphery of the bottom end of spacer 54 and the inner edge of base section 15 of stator S so that groove pumping section spacer 54 is not restrained directly by the casing. The reason is as follows.

For those turbo-molecular pumps that have vane pumping section $L_1$ and groove pumping section $L_2$ made into an integral unit, damage to rotor R is most likely to occur at the bottom end of the groove pumping section. Firstly, this is because the top end of spiral groove section 34 is constrained by vane pumping section $L_1$, but the bottom end is not restrained, therefore, the elastic deformation caused by the mass of the high speed rotor R is greater towards the bottom side of the pump unit. Secondly, the bottom section of spiral groove section 34 is subjected to a high pressure process gases used in semiconductor device manufacturing, making this section susceptible to corrosion, and consequently this section is vulnerable to cracks by stresses resulting from elastic deformation.

When groove pumping section spacer 54 is deformed outward in a pump unit having its bottom end of groove pumping section spacer 54 fixed to or contacting the pump casing 14B, as shown in FIG. 8, the contact section will resist deformation and circumferential stress is transmitted directly to the casing. In contrast, in this variation of the pump, there is a clearance $T_3$ provided between the bottom end of groove pumping section spacer 54 and pump casing 14B, so that a small degree of elastic deformation is not sufficient to make them contact, and spacer 54 can rotate while sliding by way of friction reducing sleeve 58*b* without being interfered by the pump casing, thereby dissipating the rotational energy.

Figure 10:
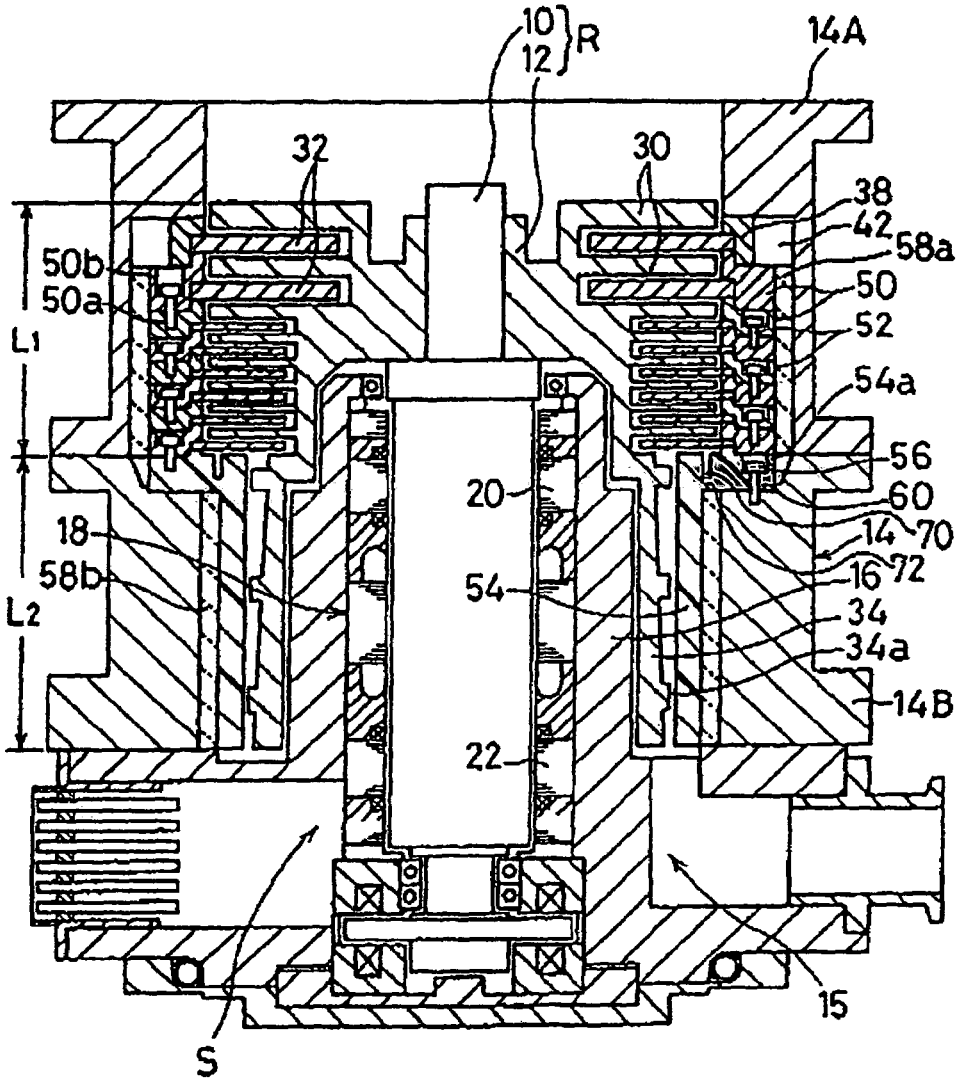
FIG. 10 is a cross sectional view of another variation of the pump shown in FIG. 8.

FIG. 10 shows an improved variation of the embodiment shown in FIG. 8, and includes a fragile section 72 comprised by a notched fracturing groove section 70 extending in the circumferential direction provided at the boundary between groove pumping section spacer 54 and flange section 54*a* for relieving the stress by fracturing. This variation of the fourth embodiment provides constriction release by breaking at fragile section 72 along the fracturing groove section 70 when an abnormal torque exceeding a threshold value is applied to groove pumping section spacer 54, leading the main section of groove pumping section spacer 54 to be separated from flange section 54*a*. In this condition, groove pumping section spacer 54 rotates with rotor R along the low friction sleeve 58*b* to gradually dissipate its rotational energy.

Figure 11:
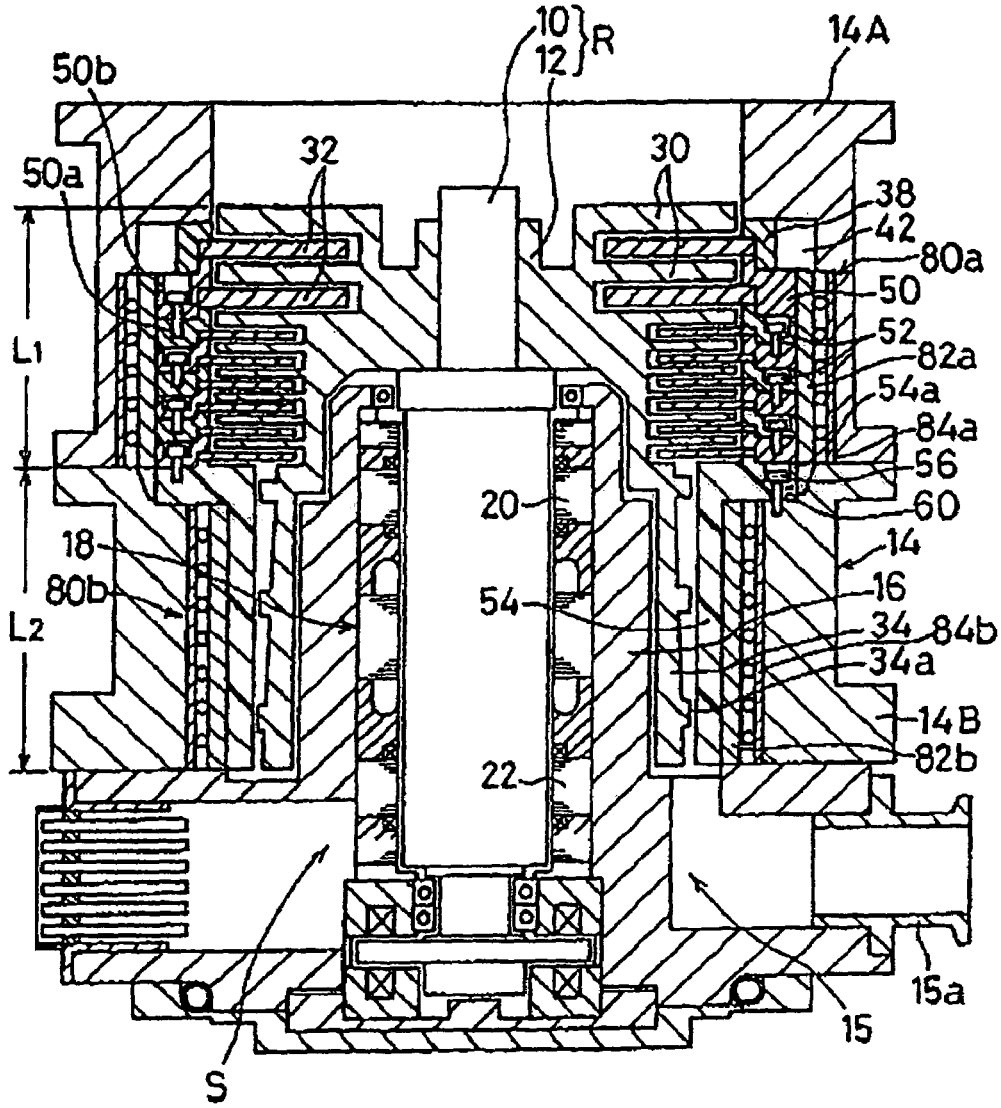
FIG. 11 is a cross sectional view of a turbo-molecular pump of a fifth embodiment according to the present invention.

FIG. 11 shows a fifth embodiment of the pump comprised by a split pump casing 14 having an intake-side pump casing 14A and an exhaust-side pump casing 14B, and a ball bearing devices (friction reducing structure) 80*a*, 80*b*, respectively, between stator vane spacers 50 and the intake-side pump casing 14A on one hand, and between groove pumping section spacer 54 and the exhaust-side pump casing 14B. These ball bearing devices 80*a*, 80*b* are comprised by inner sleeves 82*a*, 82*b* and outer sleeves 84*a*, 84*b* with bearing balls therebetween. Inner sleeves 82*a*, 82*b* are made thicker, and therefore, stronger than outer sleeves 84*a*, 84*b*.

Protective mechanism of this embodiment is as follows. Because inner sleeves 82*a*, 82*b* are made stronger than outer sleeves 84*a*, 84*b*, if abnormal conditions develop on the rotor components of rotor R or its fragment impact upon stator S to apply high local stresses to stator S, inner sleeves 82*a*, 82*b* are able to withstand the stresses to avoid deformation of raceway surfaces so that ball bearing device 80*a*, 80*b* can continue to operate relatively undisturbed. It should be noted that outer sleeves 84*a*, 84*b* are supported by casings 14A, 14B so that deformation is small and their traces of revolution will remain essentially intact even though they are thinner.

It is permissible to use rollers in stead of balls in bearing device as the friction reducing mechanism, and in this case also, inner sleeves should be made thicker than the outer sleeves to achieve the same effect as above.

Figure 12:
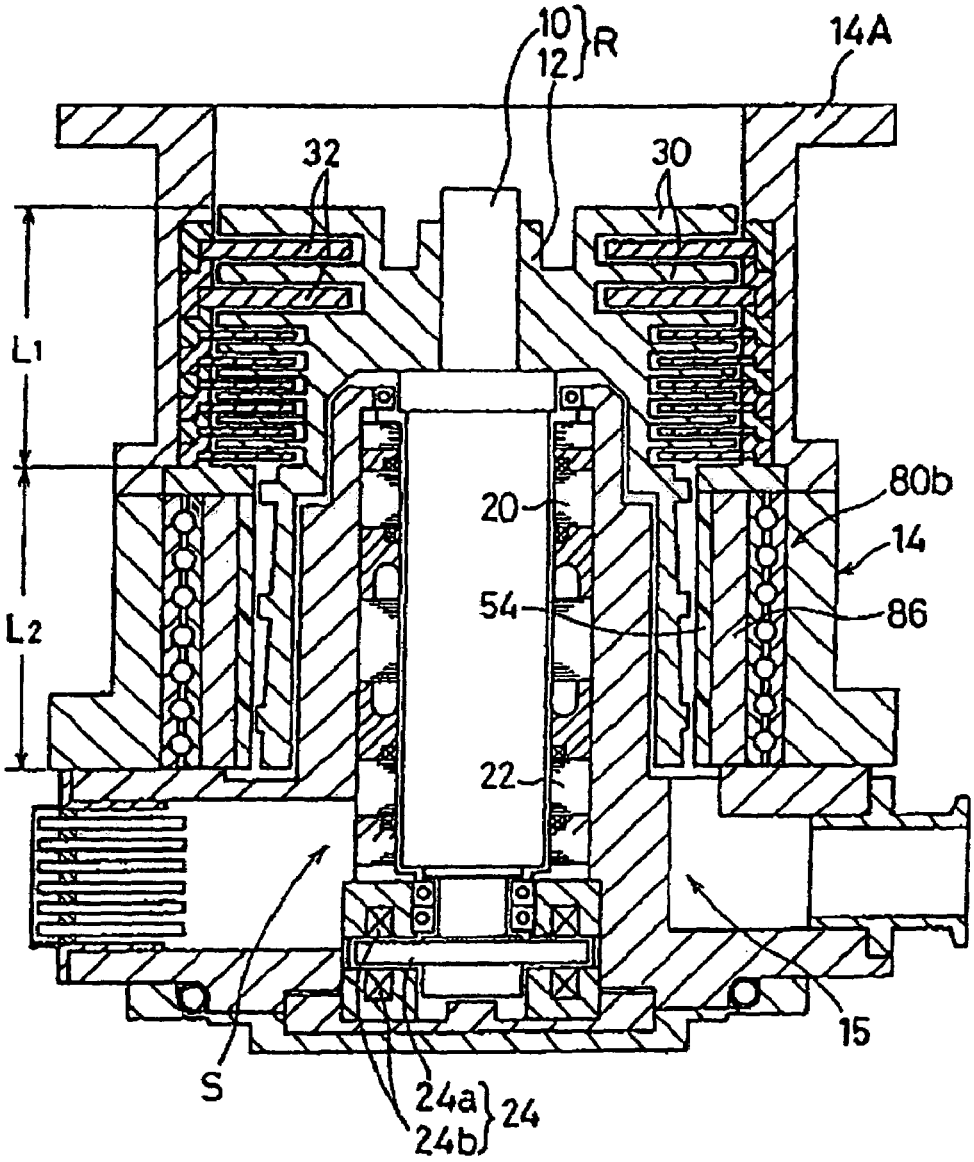
FIG. 12 is a cross sectional view of a turbo-molecular pump of a sixth embodiment according to the present invention.

FIG. 12 shows a sixth embodiment which is an improvement in the pump structure presented in FIG. 11. In this pump unit, groove pumping section $L_2$ is provided with an impact absorbing member (impact absorbing structure) 86 between groove pumping section spacer 54 and ball bearing device 80*b*. Suitable material for impact absorbing member 86 are relatively soft metals, polymer or their composite material. By providing an impact absorbing material between stator S and pump casing 14, stress transmission from stator S to pump casing 14 can be prevented to avoid damaging pump casing 14 or the vacuum processing system. By using both the friction reducing structure such as ball bearing device 80*b* and the impact absorbing structure, even greater advantages may be obtained.

Figure 13A:
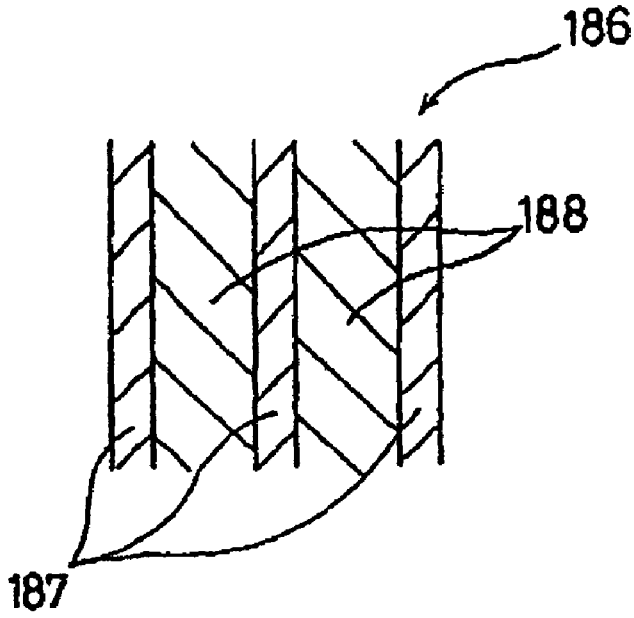
FIG. 13A is a cross sectional view of an embodiment of the impact absorbing member.
Figure 13B:
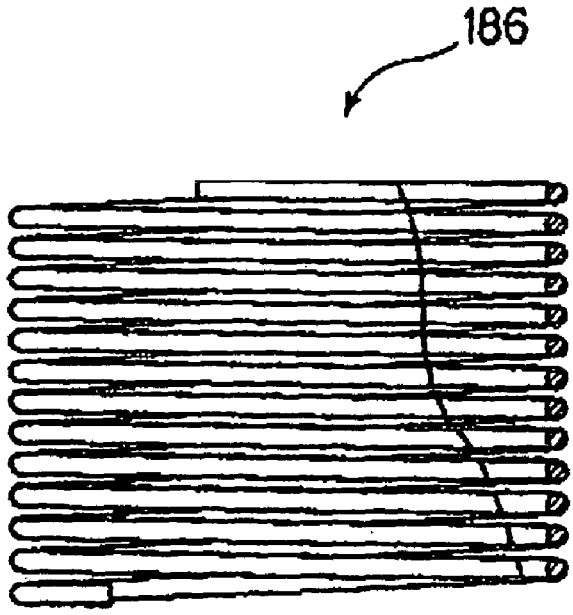
FIG. 13B is a cross sectional view of another embodiment of the impact absorbing member.

FIGS. 13A and 13B show embodiments of the composite structure of an impact absorbing member 186. In FIG. 13A, impact absorbing member 186 is made as a combined material by laminating a relatively tough or rigid material such as stainless steel plate 187 with a relatively soft and high impact absorbing material 188 such as lead plate, thus providing both impact absorbing function and shape retaining function. In FIG. 13B, impact absorbing member 186 is made as a metal pipe wound into a coil.

Figure 14:
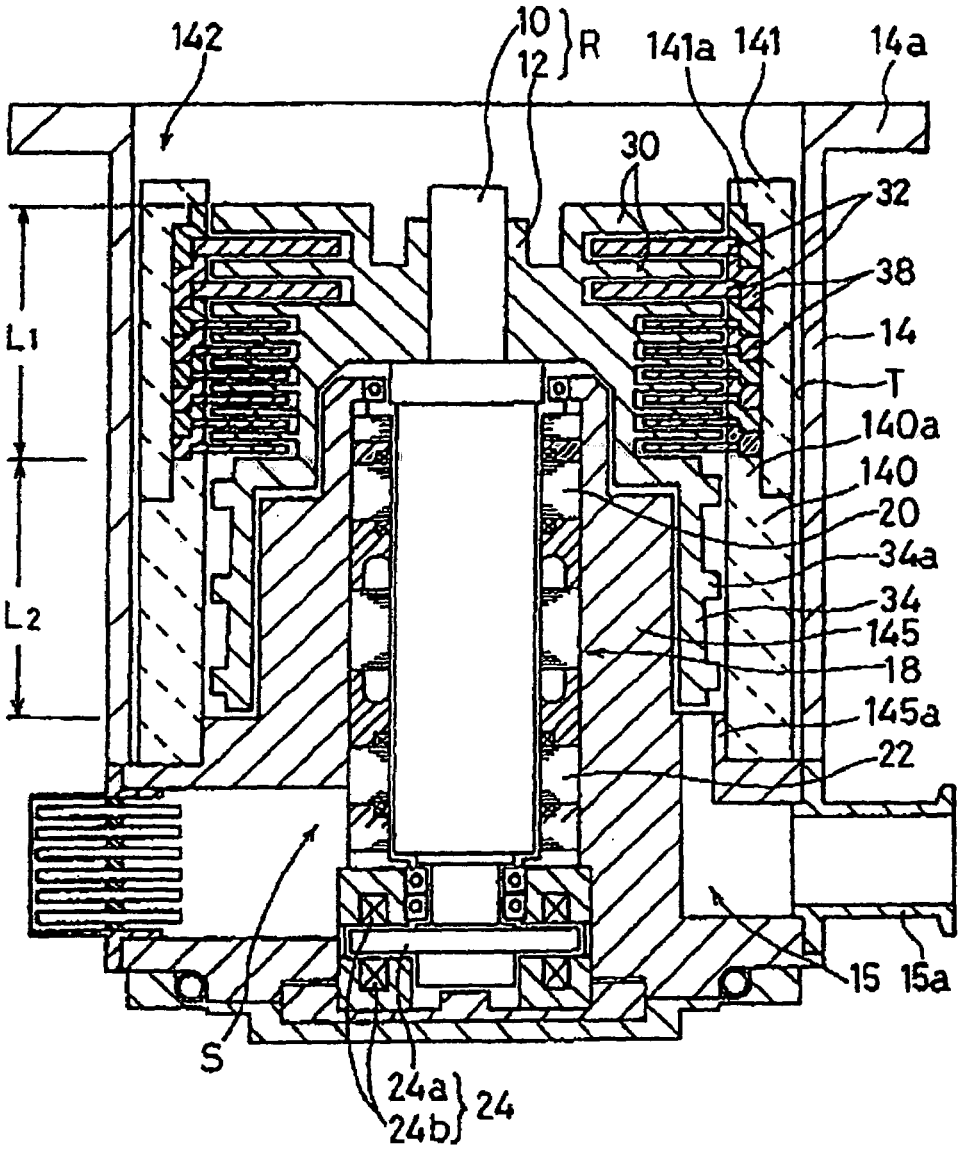
FIG. 14 is a cross sectional view of a turbo-molecular pump of another embodiment according to the present invention.

FIG. 14 shows another embodiment of the turbo-molecular pump according to the present invention. In this embodiment, an inner casing (impact absorbing structure) 142 is constructed by a lower inner casing 140 and an upper inner casing 141 respectively shaped cylindrically, which fixes stator vanes 32 and stator vane spacers 38 therein.

That is, upper inner casing 141 houses a stacked or layered assembly comprising stator vanes 32 and stator vane spacers 38 by suppressing the stacked assembly by a stepped surface 141*a* while being fixed to lower inner casing 140 by fitting the lower edge to an annular protrusion 140*a* formed on the upper edge of lower inner casing 140. Lower inner casing 140 also functions as a spiral groove section spacer to constitute groove pumping section L2 together with spiral groove section 34 of rotor cylinder section 12.

The outer diameter of inner casing 142 is set to be smaller than the inner diameter of pump casing 14 so as to form a clearance T therebetween. Inner casing 142 is fixed only by fitting the inner surface of its lower edge to the outer surface of a cylindrical large diameter portion 145*a* formed on stator cylinder section 145 of stator S. Such arrangement facilitates inner casing 142 to be dragged to rotate when the abnormal torque is transmitted to stator vanes 32 or lower inner casing (spiral vane section spacer) 140 to absorb the impact, so as to prevent such impact to be loaded to the stator system especially to pump casing 14.

The turbo-molecular pump is operated by connecting flange 14*a* to a vacuum process chamber, for example, and when rotor R is under abnormal rotation or fractured, rotor R will contact with stator vanes 32 or lower inner casing 140 to transmit the rotational torque to inner casing 142. Thus, inner casing 142 is loaded with a large force, and the stacked assembly of stator vanes 32 or inner casing 142 will partially deform to absorb the impact. Since clearance T is formed between inner casing 142 and pump casing 14, even when a part of inner casing 142 is broken or deformed, the impact is not directly transmitted to pump casing 14 so as to prevent breakage of pump casing 14 or its connection with other facilities or devices.

When a larger impact is transmitted, due to weak engagement with the stator system, fitting between inner casing 142 and large diameter portion 145*a* is released, and inner casing 142 is dragged to rotate by being guided by large diameter portion 145*a* so as further to absorb and dissipate the impact.

Here, description was made for an embodiment having a clearance T between inner casing 142 and pump casing 14, it is also effective to fill the clearance with an impact absorbing member so that the impact can be more positively absorbed. The impact absorbing member 186 can be made of relatively soft materials such as metal, high polymer, or composite materials thereof, as described above with reference to FIGS. 13A, 13B, or as will be described hereinafter with reference to FIG. 21.

Figure 15:
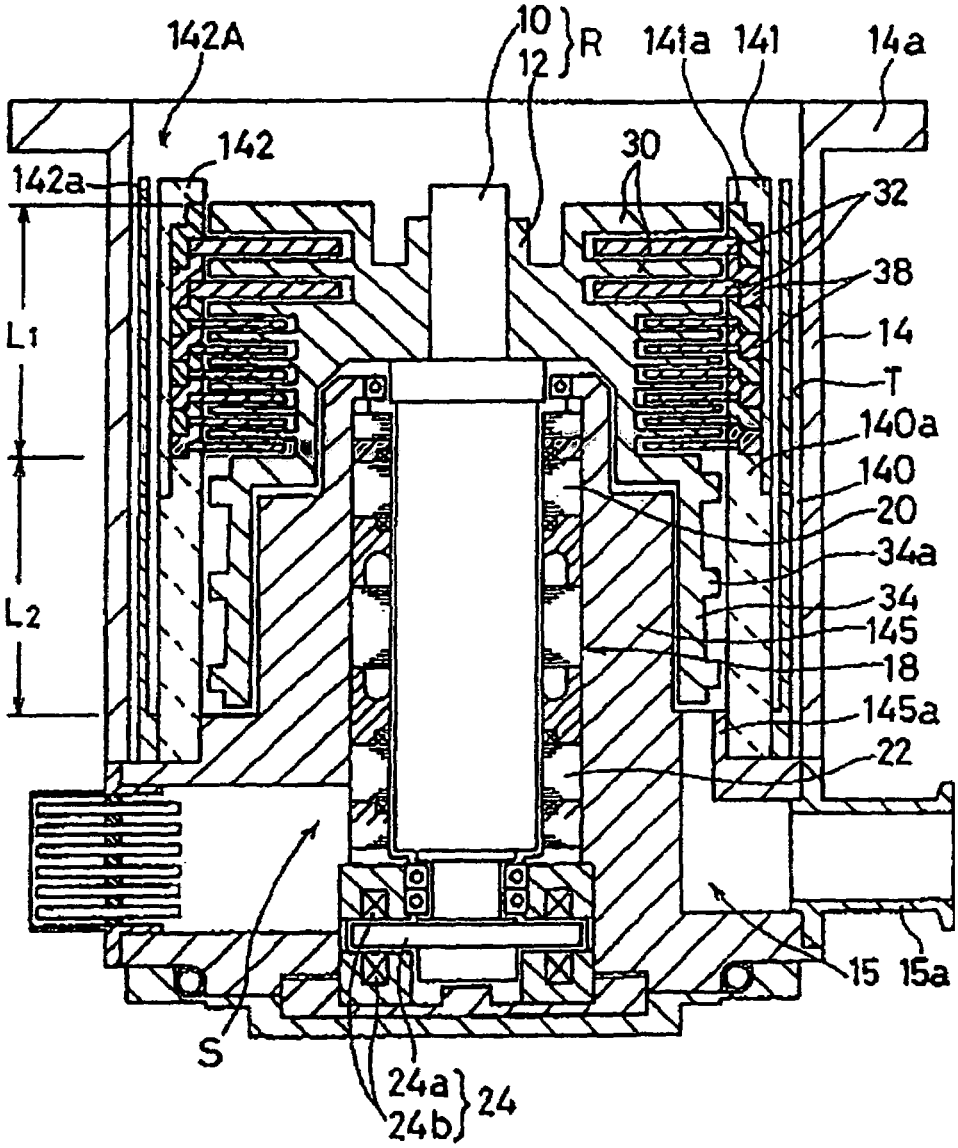
FIG. 15 is a cross sectional view of a variation of the pump shown in FIG. 14.

Although inner casing 142 has a single layer configuration in FIG. 14, it is preferable, in order to moderate the impact caused by collision of rotor fragments or to reinforce inner casing 142 itself, to construct inner casing 142A having a multiple cylindrical (more than double cylinder) construction comprising an outer secondary inner casing 142*a* around inner casing 142 of FIG. 14, as shown in FIG. 15.

Figure 16:
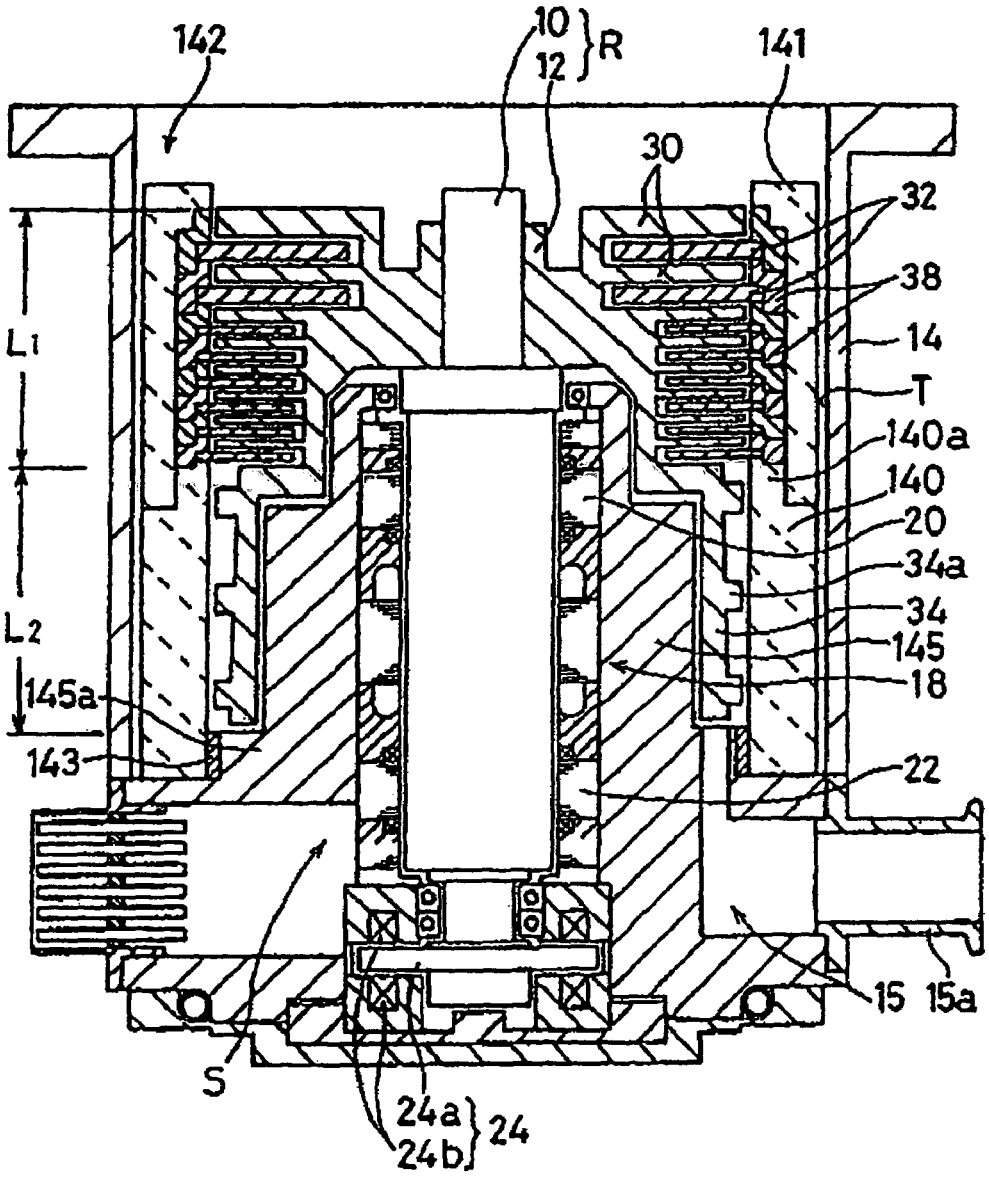
FIG. 16 is a cross sectional view of another variation of the pump shown in FIG. 14.

FIG. 16 shows a variation of the turbo-molecular pump of FIG. 14. In this embodiment, a friction reducing structure 143 is provided between the inner surface of lower inner casing 140 and outer surface of large diameter portion 145*a* of stator cylinder section 145. For such friction reducing structure 143, low-friction structures comprised by ball bearings or rod bearings may be used, as well as a member made of an inherently low friction material such as tetrafluoroethylene polymer.

In this turbo-molecular pump, friction reducing structure 143 provided between lower inner casing 140 and large diameter portion 145*a* of stator cylinder section 145 reduces the frictional force acting between them so as to facilitate lower inner casing 140 to rotate by being guided by large diameter portion 145*a*. Thus, lower inner casing 140 has improved impact absorbing ability so that it can effectively prevent abnormal rotational torque, which is generated through breakage of rotor R, from being transmitted to pump casing 14.

Figure 17:
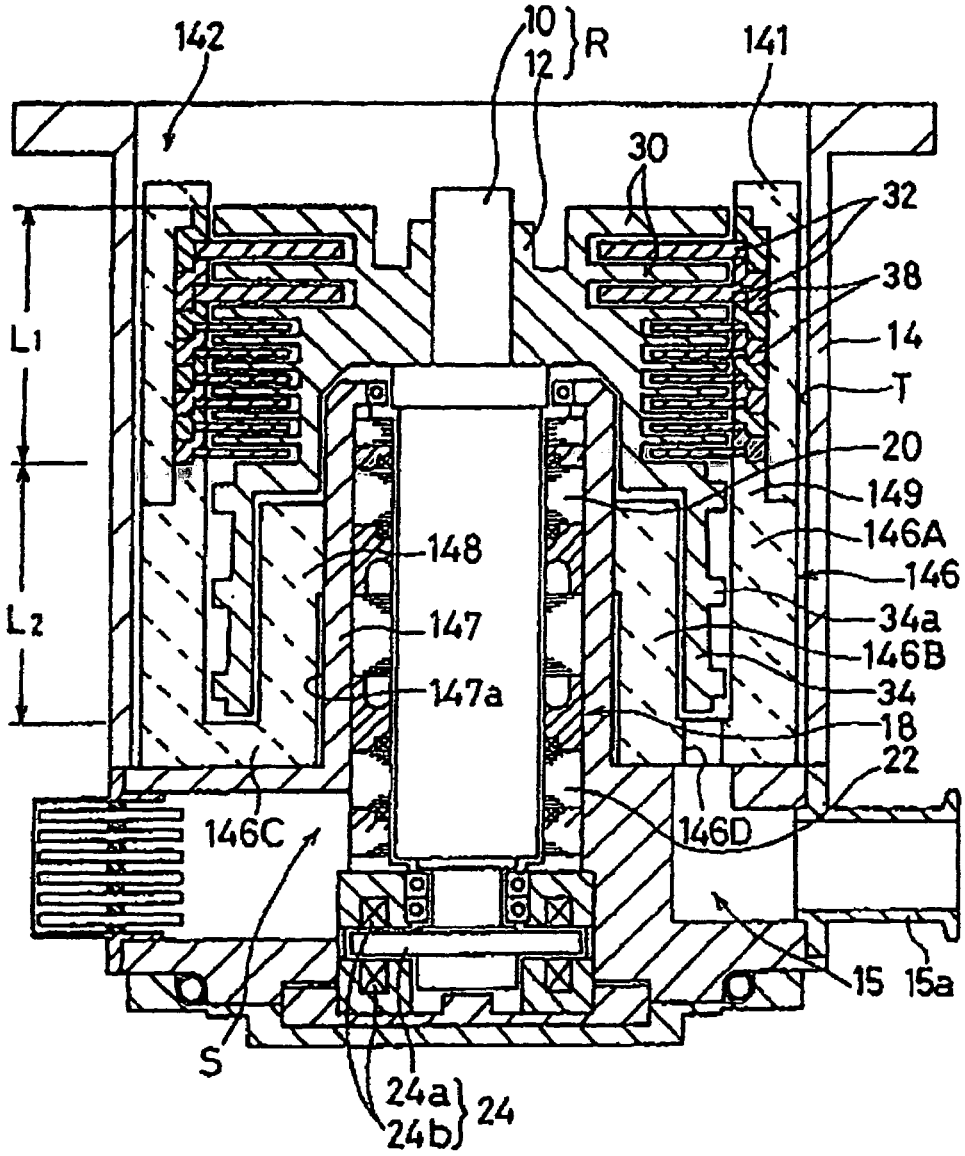
FIG. 17 is a cross sectional view of a turbo-molecular pump of another embodiment according to the present invention.

FIG. 17 shows another embodiment of the present invention. In this embodiment, lower inner casing 146 has a double cylinder configuration comprised by an outer cylindrical portion 146A located outside spiral groove portion 34 of rotor R and an inner cylindrical portion 146B located inside spiral groove portion 34, which are connected at their bottoms through connecting portion 146C. Thus, spiral groove portion 34 of rotor cylinder section 12 rotates in a space between outer cylindrical portion 146A and inner cylindrical portion 146B. On the upper inner surface of inner cylindrical portion 146B, a protrusion 148 is formed inwardly to fit with outer surface 147*a* of stator cylinder section 147 of stator S thereby to fix stator cylinder section 147.

Outer cylindrical portion 146A also functions as a spiral groove section spacer to construct groove pumping section L2 together with spiral groove section 34 of rotor cylinder section 12. A communicating hole 146D is formed in connecting portion 146C to communicate groove pumping section L2 with exhaust port 15*a*. Outer cylindrical portion 146A forms an inner casing 142 together with upper inner casing 141 having a clearance between pump casing 14 as in an embodiment of FIG. 14.

In this turbo-molecular pump, since the fragments of fractured rotor R are scattered outwardly, inner cylindrical portion 146B inside spiral groove section 34 is not likely to deform so that it can maintain the cylindrical shape. Also, since protrusion 148 for fixing inner casing 142 is in the furthest location from upper inner casing 141 which is likely to be affected by abnormal torque, the impact loaded on the upper inner casing 141 is damped in the transmission path so that shapes in the fitting between protrusion 148 and outer surface 147*a* of stator cylinder section 147 is also maintained for a relatively long period.

Therefore, even after inner cylindrical portion 146B and outer surface 147*a* are disengaged, inner casing 142 can rotate as a whole, by being guided by those engagement surfaces, together with outer cylindrical portion 146A and upper inner casing 141, thereby to suppress transmission of abnormal rotational torque caused by rotor fracture to pump casing 14.

Figure 18:
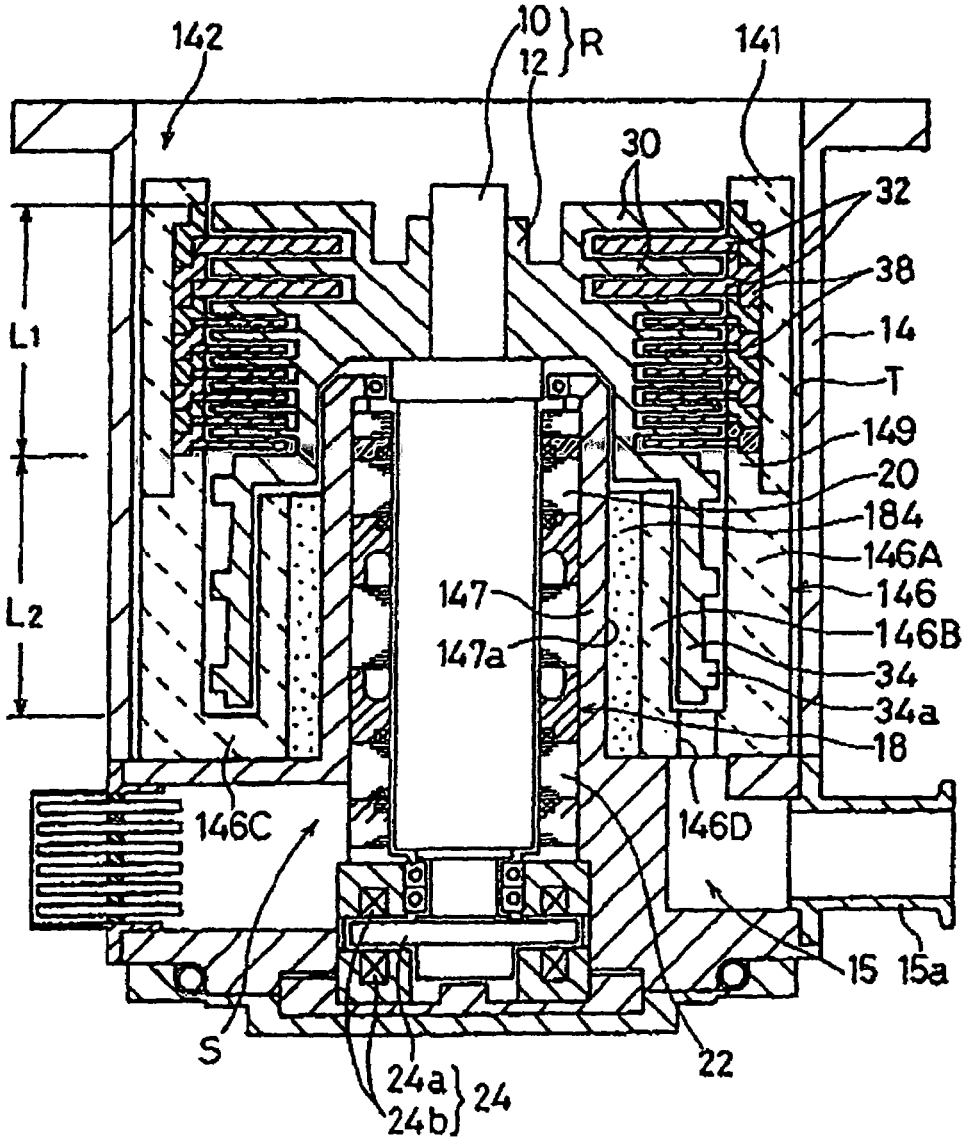
FIG. 18 is a cross sectional view of a variation of the pump shown in FIG. 17.

FIG. 18 shows a modification of the embodiment shown in FIG. 17, in which inner cylindrical portion 146B is formed as lower inner casing 146, for constructing inner casing 142, having a smaller thickness than that shown in FIG. 17, and a friction reducing member 184 made of a material such as tetrafluoroethylene polymer is inserted between the inner surface of inner cylindrical portion 146B and outer surface 147*a* of stator cylinder section 147 of stator S.

In this turbo-molecular pump, friction reducing member 184 provided between inner cylindrical portion 146B and stator cylinder section 147 reduces the frictional force acting between them so as to facilitate inner cylindrical portion 146B to rotate by being guided by stator cylinder section 147 together with outer cylindrical portion 146A or upper inner casing 141. Thus, it can further reduce transmission of abnormal rotational torque, which is generated through breakage of rotor R, to pump casing 14.

Figure 19:
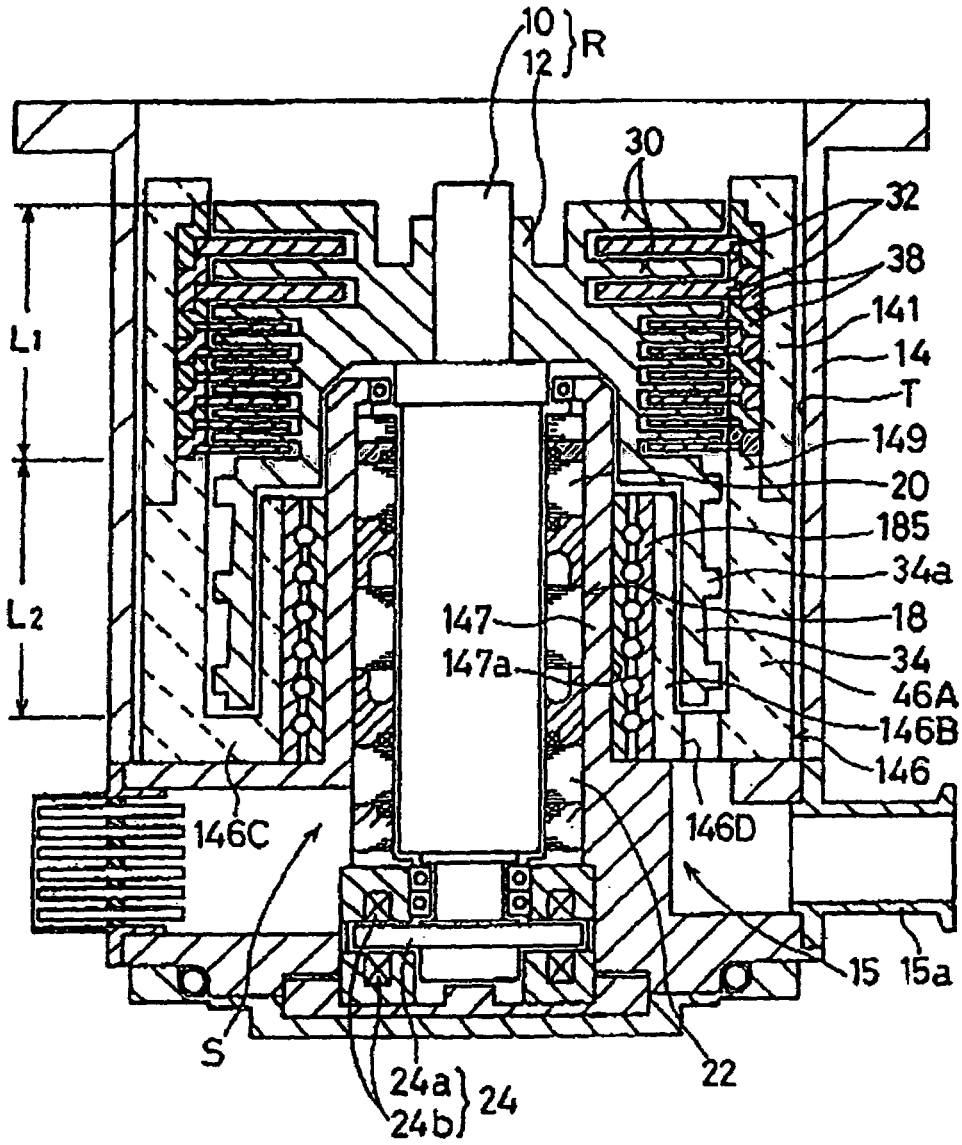
FIG. 19 is a cross sectional view of another variation of the pump shown in FIG. 17.

FIG. 19 shows another modification of the embodiment shown in FIG. 17, in which a mechanical bearing such as a ball bearing or a roller bearing 185 is used as the friction reducing structure instead of friction reducing member 184 shown in FIG. 18, so that inner cylindrical portion 146B etc. can be more easily rotated.

Figure 20:
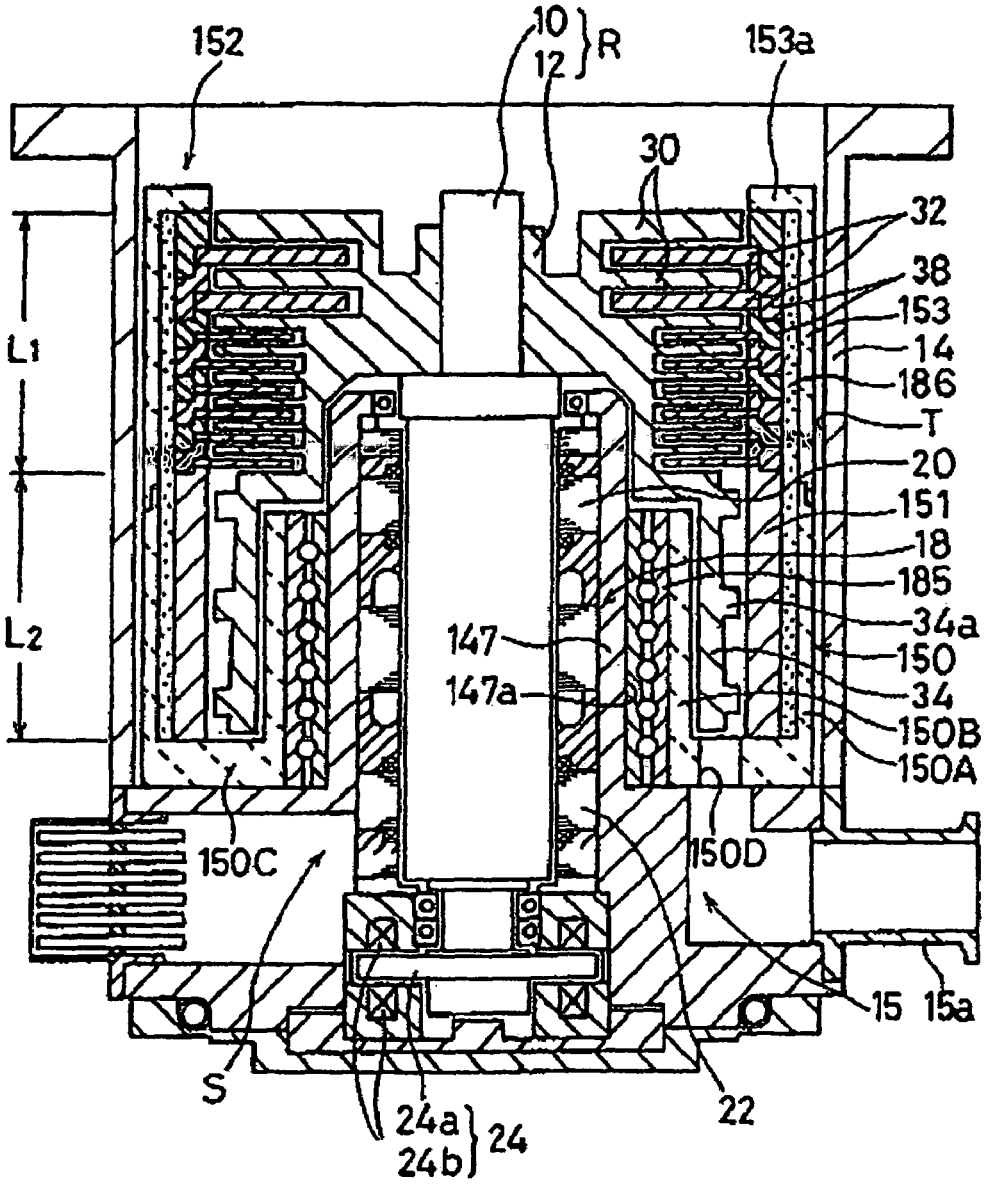
FIG. 20 is a cross sectional view of a turbo-molecular pump of another embodiment according to the present invention.

FIG. 20 shows a turbo-molecular pump of another embodiment according to the present invention. In this embodiment, lower inner casing 150 and spiral groove section spacer 151 are separately provided. That is, the stacked assembly comprising stator vanes 32 and stator vane spacers 38, and spiral groove section spacer 151 are fixedly held by lower inner casing 150 and upper inner casing 153, which are mutually fitted to construct inner casing 152. Upper inner casing 153 comprises an annular suppressing portion 153*a* protruding inwardly from the upper edge thereof.

An impact absorbing member 186 is provided between the inner surfaces of outer cylindrical portion 150A and upper inner casing 153 and the outer surfaces of each stator vane spacer 38 and spiral groove section spacer 151, which is made of a material such as relatively soft metal, high polymer, or composite material thereof.

The lower inner casing is comprised by an outer cylindrical portion 150A and an inner cylindrical portion 150B connected by connecting portion 150C comprising communicating hole 150D, as similar to FIG. 19. A friction reducing structure (mechanical bearing) 185 is provided between the inner surface of inner cylindrical portion 150B and outer surface 147*a* of stator cylinder section 147 of stator S.

In this embodiment, since impact absorbing member 186 is provided between outer cylindrical portion 150A and upper inner casing 153, and each stator vane spacer 38 and spiral groove section spacer 151, additional effects to that of the embodiment of FIG. 19 are obtained such that, the amount of impact force transmitted to inner casing 152 itself is reduced, which has been transmitted from rotor R to stator vane spacers 38 etc. The protection function of inner casing 152 has been improved, resulting in that clearance T between upper inner casing 153 or outer cylindrical portion 150A and pump casing 14 can be smaller to enable the overall pump to be compact.

Figure 21A:
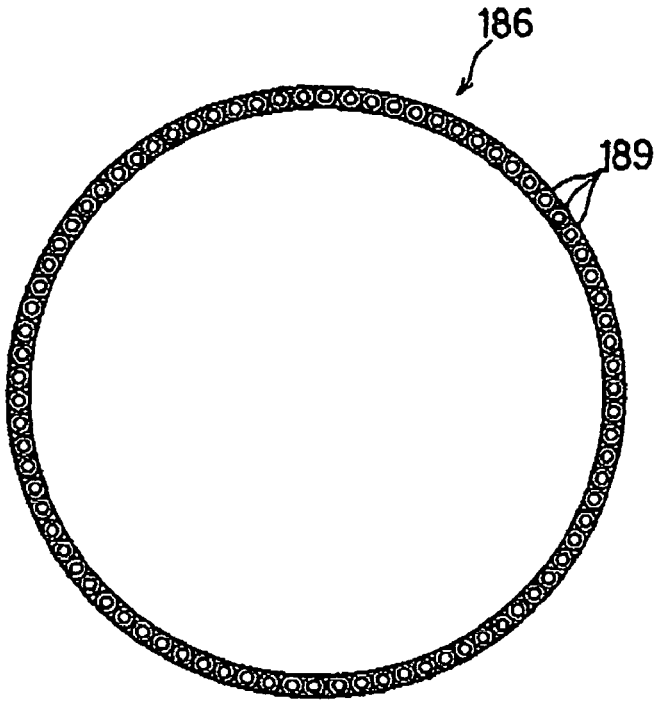
FIG. 21 is a cross sectional view and a perspective view of another embodiment of the impact absorbing member.
Figure 21B:
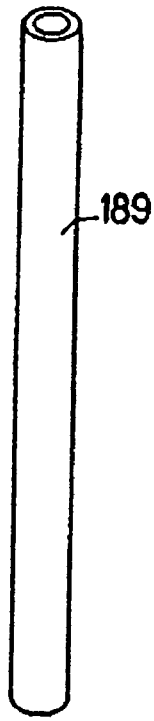

FIG. 21 shows another embodiment for impact absorbing member 186 shown in FIG. 20, comprising axially elongated pipes 189 which are laterally stacked into a cylindrical shape and arranged in a space between inner casing 142 and stator vane spacer 38 or spiral groove section spacer. The impact absorbing member 186 of this embodiment has advantages of enabling easy manufacturing of the pipe and easy assembly of the turbo-molecular pump. Impact absorbing member 186 is not limited to this embodiment, and materials such as relatively soft metal, high polymer, or composite materials thereof can be shaped into an impact absorptive configuration such as honeycomb structure or aggregate of simple spheres. It is preferable to select corrosion resistant raw material in consideration of evacuating corrosive gases, and a similar effect can be obtained at a lower cost by applying corrosion resistant surface treatment such as nickel coating.

Figure 22:
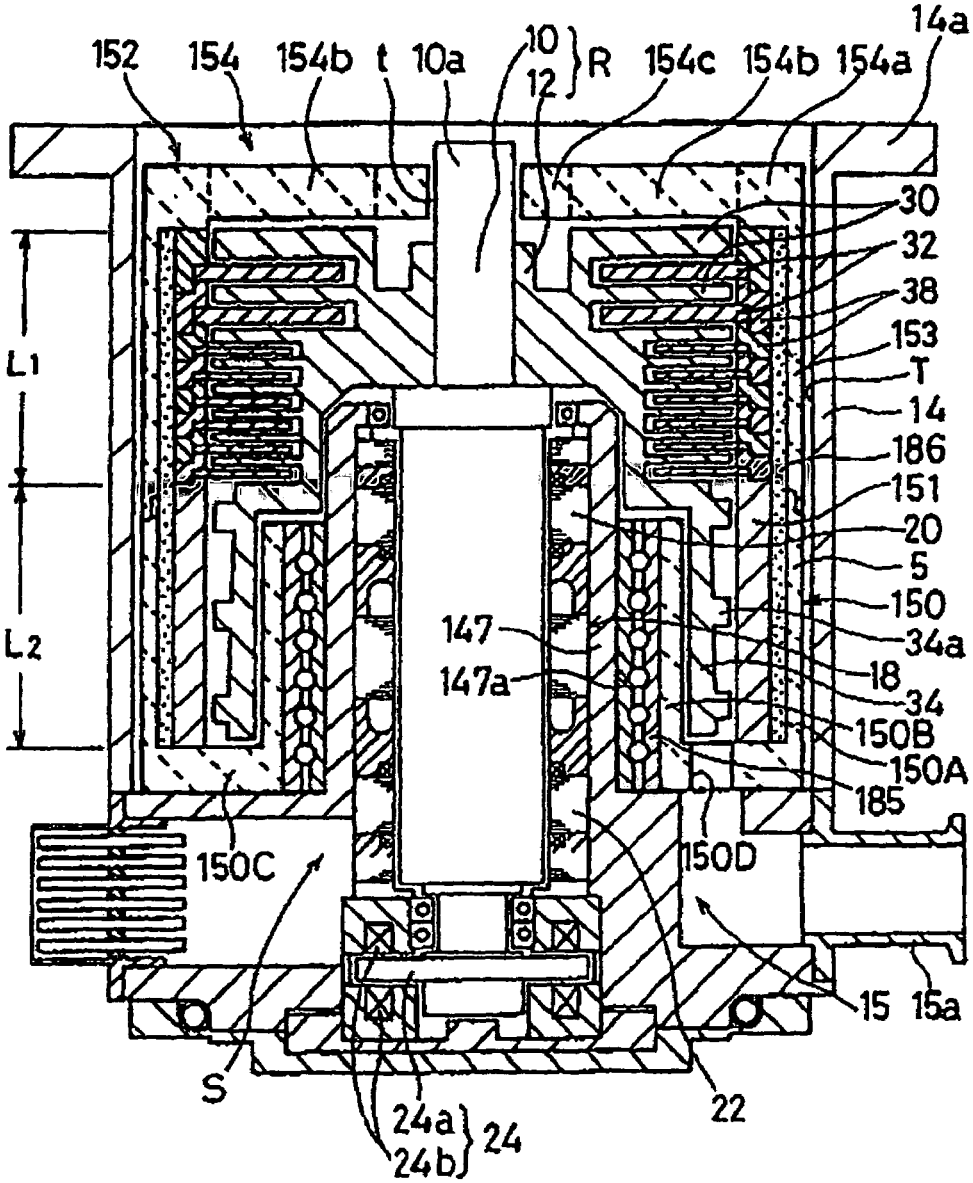
FIG. 22 shows a cross sectional view of a turbo-molecular pump of another embodiment according to the present invention.
Figure 23:
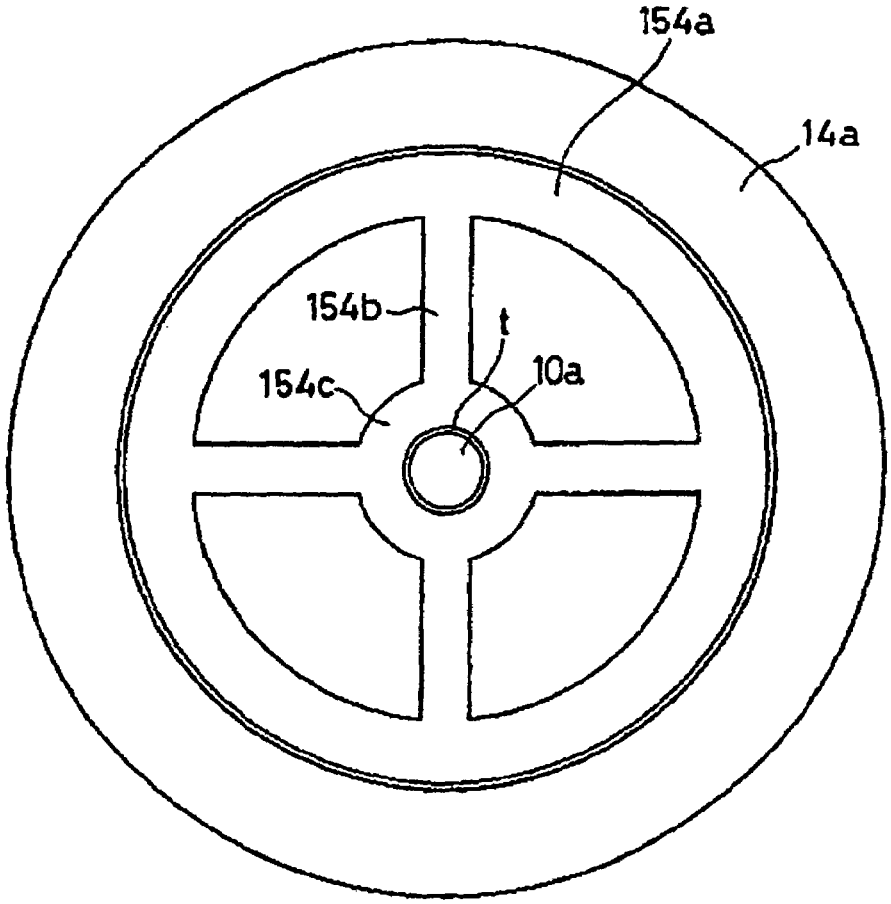
FIG. 23 is a top view of a turbo-molecular pump shown in FIG. 22.

FIGS. 22 and 23 show a turbo-molecular pump of another embodiment according to the present invention. In this embodiment, another impact absorbing structure 154 is additionally provided at the upstream of vane pumping section L1, i.e., at the entrance of the turbo-molecular pump shown in FIG. 20. Specifically, an extended portion 10*a* is provided at the top of main shaft 10, and an annular suppressing portion 154*a* is formed at the top of upper inner casing 153. Stay members 154*b* are provided to inwardly protrude form annular suppressing portion 154*a* and are connected to a ring shaped upper inner cylindrical portion 154*c*, which surrounds extended portion 10*a* with a small gap t.

In the turbo-molecular pump, additional effects can be obtained to that of FIG. 20, as follows. That is, separate impact absorbing structure 154 is provided at the upstream of vane pumping section L1, where there are no rotor vanes 30 or stator vanes 32 so that it is not affected by collision etc. resulting from fracture of the vanes. Thus, suppressing portion 154*a*, stay member 154*b*, upper inner cylindrical portion 154*c* can maintain their configuration, so that whole inner casing 152 can rotate about main shaft 10 for longer period while sliding against extended portion 10*a* of main shaft 10 thereby to maintain the impact absorbing function for longer period.

Figure 24:
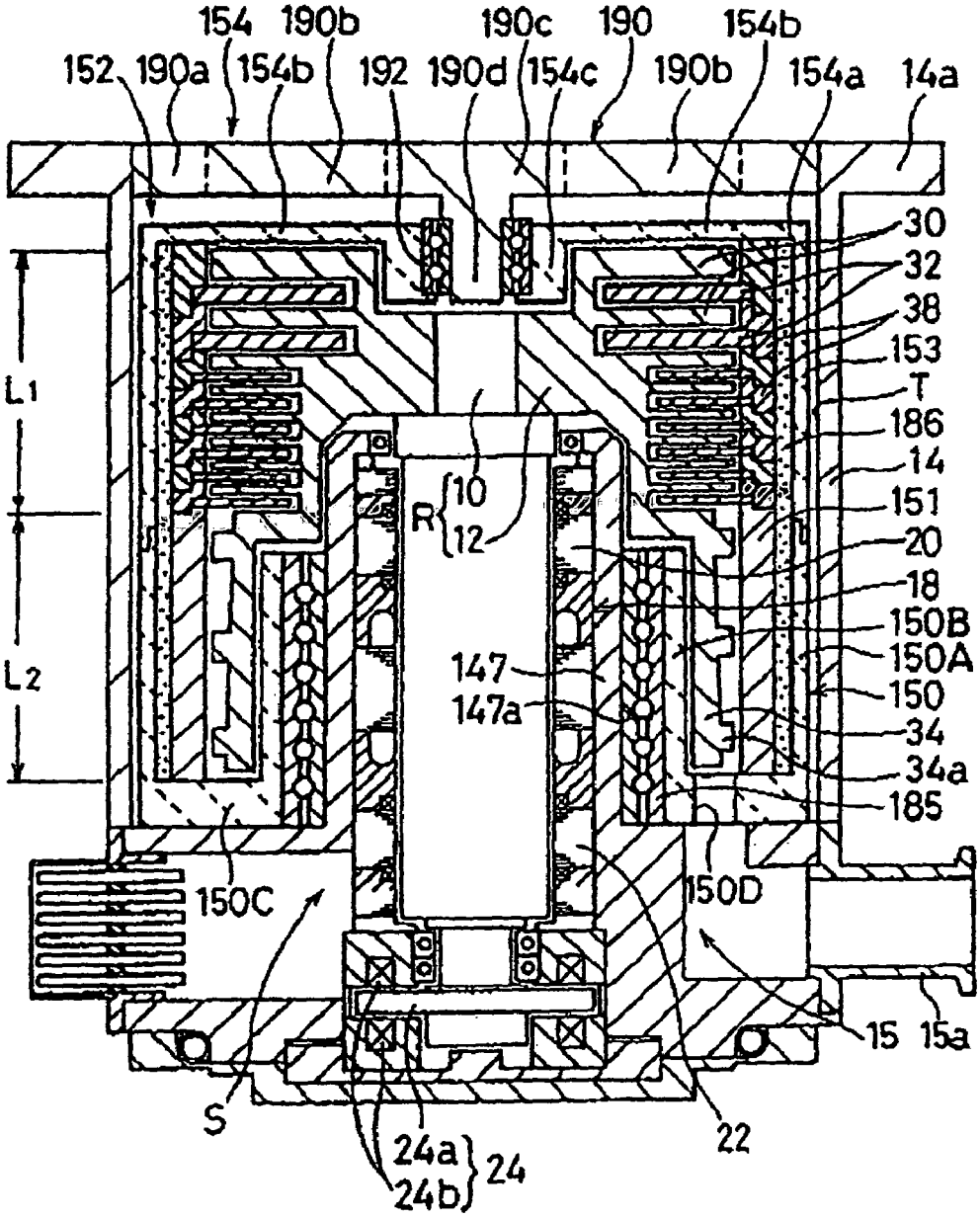
FIG. 24 is a cross sectional view of a turbo-molecular pump of another embodiment according to the present invention.
Figure 25:
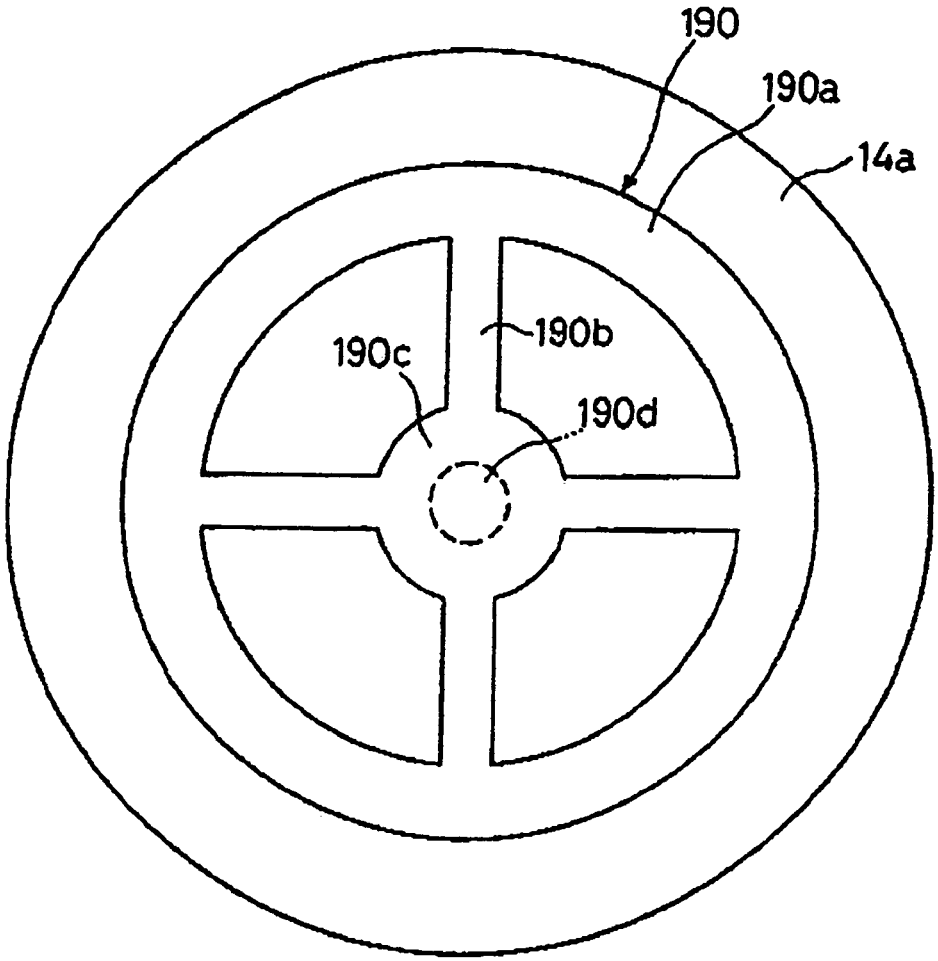
FIG. 25 is a top view of a turbo-molecular pump shown in FIG. 24.

FIGS. 24 and 25 show a turbo-molecular pump of another embodiment according to the present invention. In this embodiment, impact absorbing structure 154 at the entrance is mounted on a shaft body fixed to stator S, instead of rotor R, by way of friction reducing structure. That is, the upper end of main shaft 10 is shorter, and bearing supporting member 190 is provided to protrude inwardly from the top inner surface of pump casing 14.

Bearing supporting member 190 comprises an annular section 190*a* fixed to pump casing 14, stay members 190*b* extending radially inwardly from annular section 190*a*, a disc 190*c* connected to stay members 190*b* at the central region, and cylindrical shaft 190*d* extending downward from disc 190*c*. On the other hand, a rectangular plate-like stay members 154*b* is provided to radially inwardly extend from annular suppressing portion 154*a* of upper inner casing 153, and upper inner cylindrical portion 154*c* is formed at the central region of stay members 154*b* above main shaft 10. A mechanical bearing (friction reducing mechanism) 192 is provided between the outer surface of shaft body 190*d* and upper inner cylindrical portion 154*c*.

In the turbo-molecular pump, since impact absorbing structure 154 is attached around shaft body fixed to stator S byway of friction reducing mechanism 192, it can more effectively function to maintain the rotation of inner casing 152 than the embodiment shown in FIG. 22.

Figure 26:
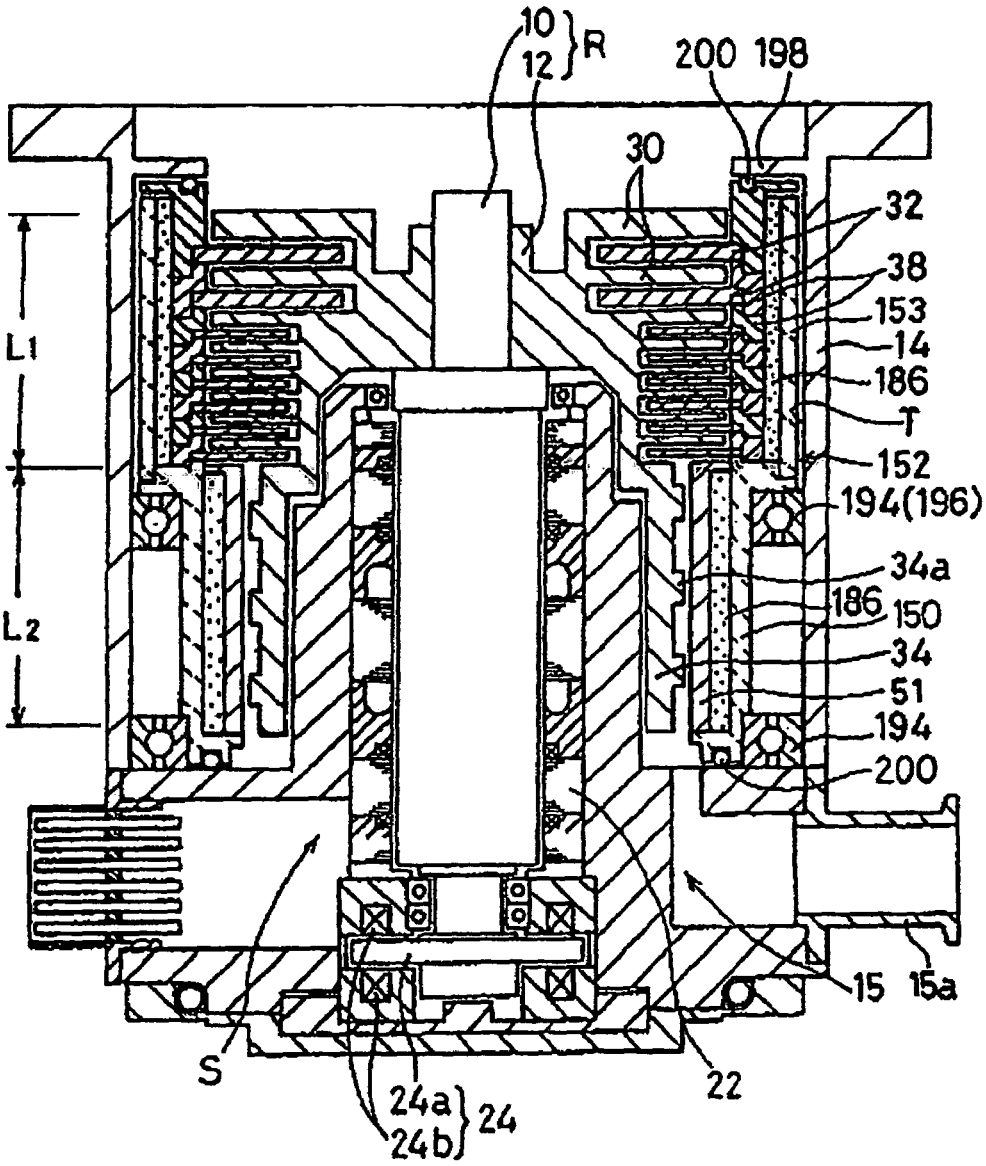
FIG. 26 is a cross sectional view of a turbo-molecular pump of another embodiment according to the present invention.
Figure 27:
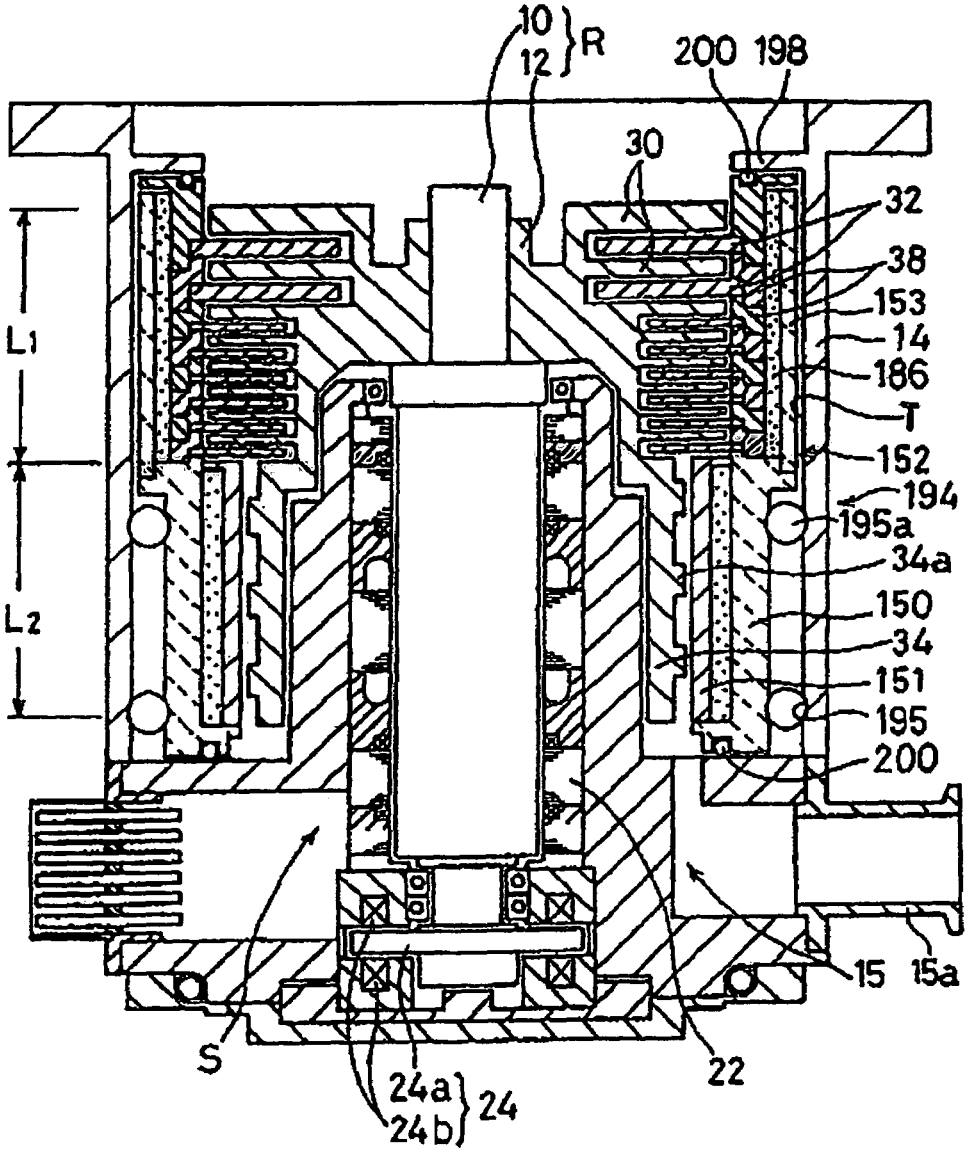
FIG. 27 is a cross sectional view of another embodiment of the mechanical bearing.

FIG. 26 shows a modification of the embodiment shown in FIG. 20, in which a lower inner casing 150 and upper inner casing 153, for constructing inner casing 152, have respective different outer diameters. That is, lower inner casing 150 is not provided with inner cylindrical portion 150B so that lower inner casing 150 has a smaller outer diameter than upper inner casing 153. This is because stator S is loaded with a higher stress from rotor R in spiral groove pumping section L2 than in vane pumping section L1 so that smaller diameter in spiral groove pumping section L2 than in vane pumping section L1 makes the turbo-molecular pump operation more stable.

Likewise FIG. 20, an impact absorbing member 186 is arranged in the spaces between upper inner casing 153 and stator assembly comprising stator vane spacers 38 of vane pumping section L1 or lower inner casing 150 and spiral groove section spacer 151, which is made from a coil-shaped pipe, respectively.

A friction reducing mechanism 196 comprising two (upper and lower) mechanical bearings 194 are provided in a space between lower inner casing 150 thus constructed and pump casing 14. Friction reducing mechanism 196 has a larger diameter than the mechanical bearing provided on stator cylinder section 147 side shown in FIG. 20, so that it can support inner casing 152 more stably while it rotates when abnormal torque is generated. Since mechanical bearing 194 is arranged in a space between lower inner casing 150 and pump casing 14, impact absorbing structure can be assembled without increasing the overall dimension of the turbo-molecular pump.

Since these two bearings 194 receive a large radial force when rotor R is fractured, it is preferable to enhance their supporting ability by providing a wide axial distance therebetween thereby to avoid slanting of inner casing 152. It is preferable to locate one close to intake port of vane pumping section L1, and the other close to exhaust port of spiral groove pumping section L2, or more than three bearings can be provided along the axial direction.

As for mechanical bearing 194, a deep groove ball bearing or a roller bearing can be used for exclusively receiving the radial direction load, but angular bearings can be used in a single or combined arrangement to receive axial load potentially loaded in case when rotor R is fractured. It is preferable, in case of handling corrosive gases, to manufacture the bearing from corrosion resistant material such as stainless steel, or to apply surface treatment such as nickel coating to a less corrosion resistant material.

Mechanical bearing 194 can be constructed, instead of using a readily assembled one, by forming raceway surfaces 195 directly on the surfaces of pump casing 14 and inner casing 152 and providing only balls 195*a* on the raceway surfaces when assembling thereby to save the manufacturing cost.

In this embodiment, in order to prevent the exhaust gas from reversely flowing from discharge side to intake side or to protect the mechanical bearing from corrosive gases, sealing members 200 are provided between the uppermost stator vane spacer 38 of vane pumping section L1 and suppressing member 198 protruding from inner surface of pump casing (outer casing) 14, and between lower inner casing 150 and stator. Seal member 200 can be made as an O-ring or a sheet formed from material such as fluoro rubber.

Since stator vane spacers 38 or spiral groove section spacer 151 may be brought in contact with pump casing 14 or stator S when inner casing 142, 152 are rotated to interfere with rotation, it is preferable to reduce its radial direction thickness as much as possible so as to minimize the area of regions close to or in contact with pump casing 14 or stator S. It is also preferable to provide a local fragility structure (such as circumferential slot) so as to assure axial mechanical disengagement of those members when an abnormal torque is applied.

Figure 28:
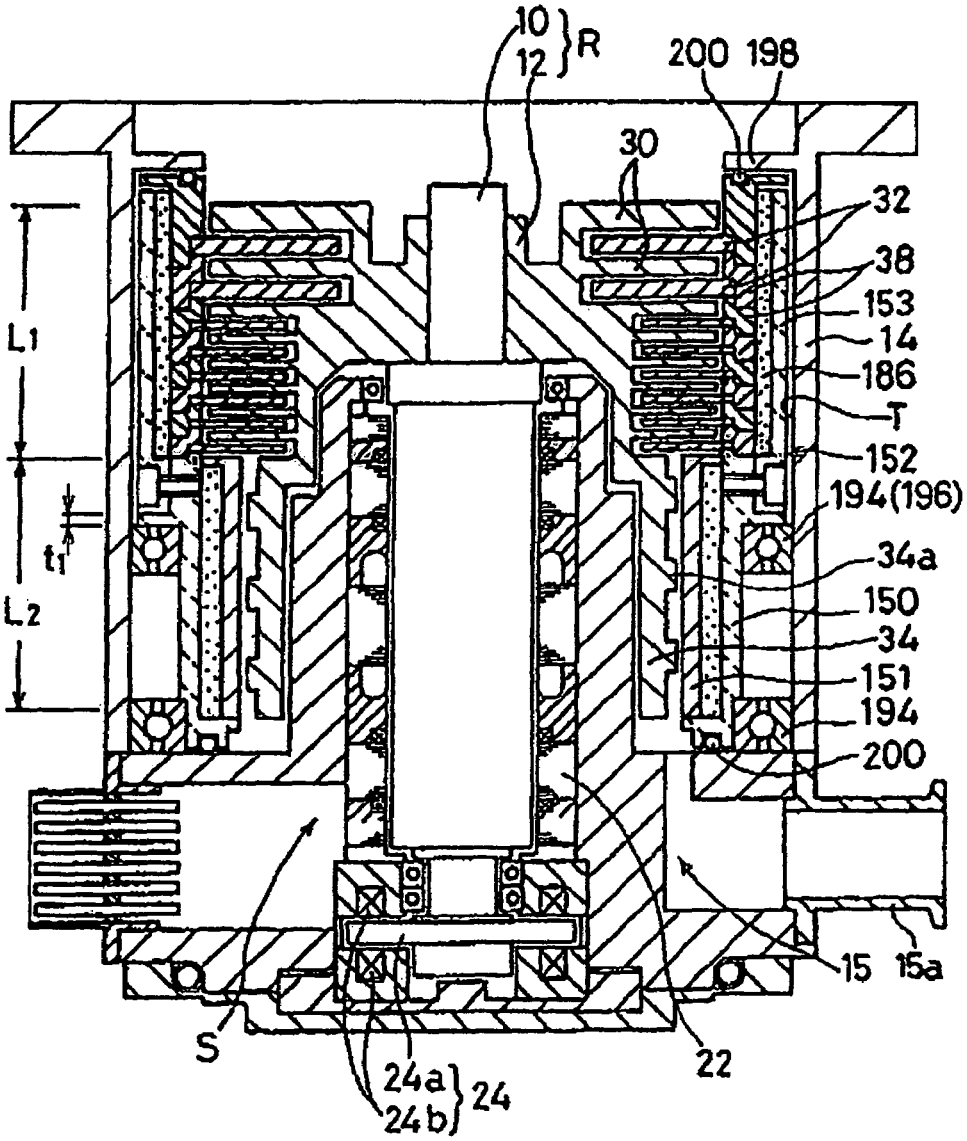
FIG. 28 is a cross sectional view of a turbo-molecular pump of another embodiment according to the present invention.

In the above described embodiments, suitable thickness of inner casing 142, 152, or clearance T between inner casing 142, 152 and pump casing 14 is several millimeters (3 mm~10 mm). Also, configuration of the connection between upper inner casing 141, 153 and lower inner casing 140, 146, 150 shown in FIG. 28 is effective, in which the lower flange thickness $\mu l$ is made as small as 3~5 mm and the bolts are inserted radially from outside, because such configuration can reduce the radial size of the pump as well as secure a wide axial length between the bearings. Size of the bolt is suitably M6~M10, and number is suitably from several to less than 50.

In the embodiments above, inner casing 142, 152, stator vanes 32 or stator vane spacers 38 are loaded with impact in case of rotor fracture, so that these elements should be made of materials with high strength and high elongation such as stainless steel or aluminum alloys. Especially aluminum alloys are effective in consideration of cost saving and weight reduction of the pump. Also, use of aluminum alloys having high specific strength for pump casing 14 is effective for weight reduction. Stator vane spacer 38 can be made into deformable shape by providing a circumferential groove etc. so that the spacer itself can moderate the impact force.

Figure 29:
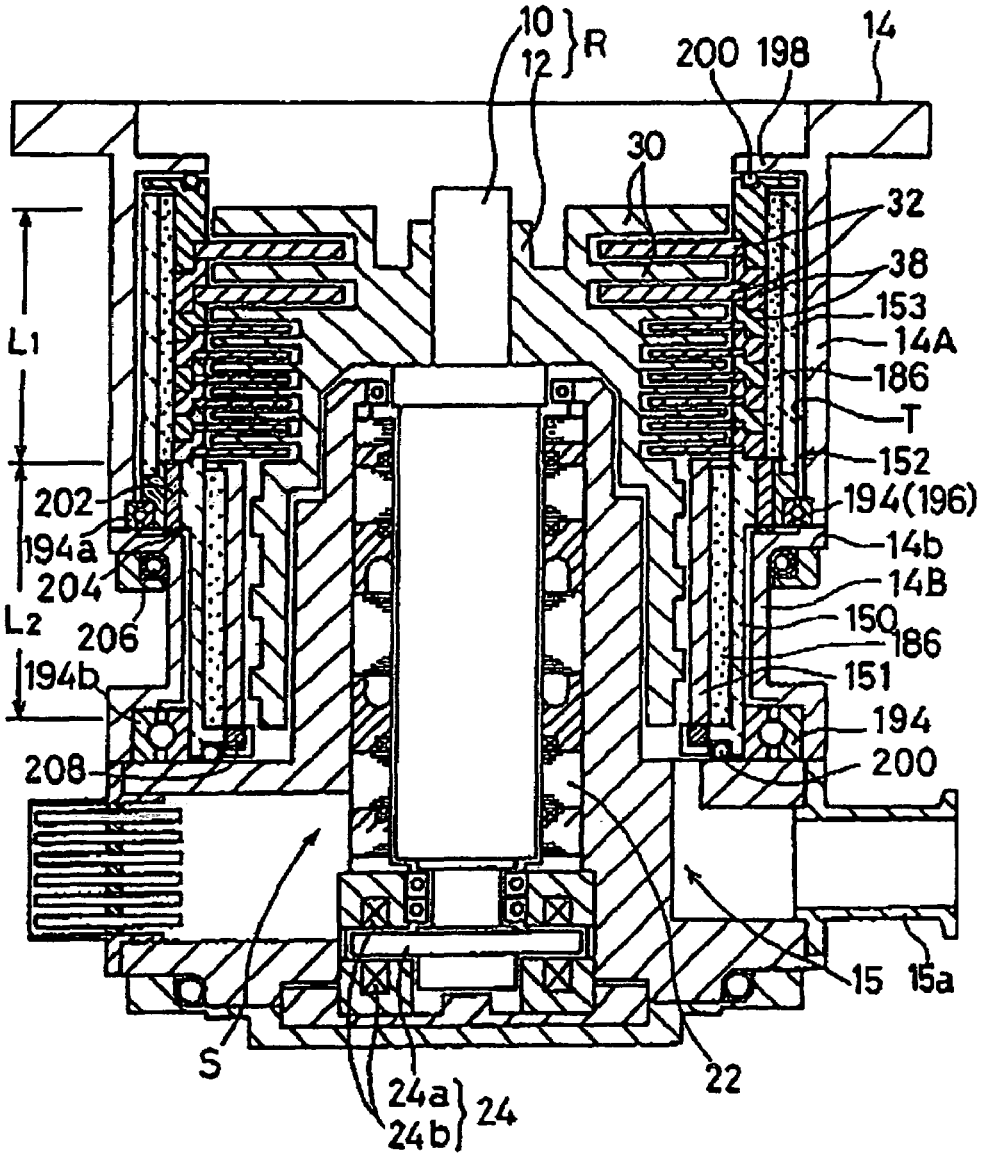
FIG. 29 is a cross sectional view of a turbo-molecular pump of another embodiment according to the present invention.
Figure 30:
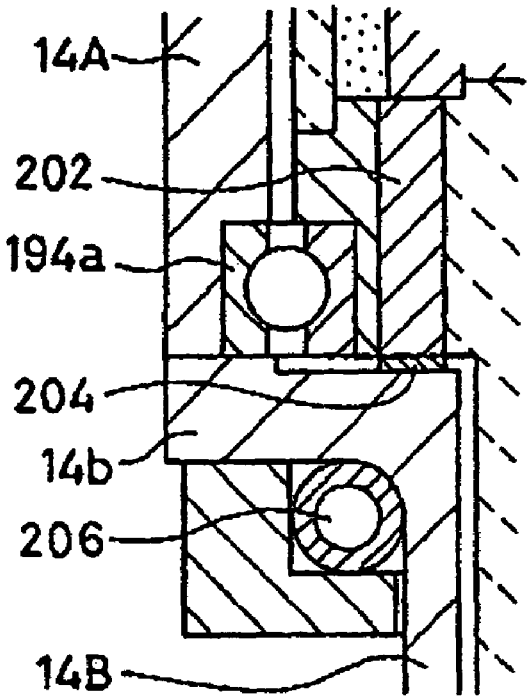
FIG. 30 is a partially enlarged view of a turbo-molecular pump shown in FIG. 29.

FIGS. 29 and 30 show a modification of the embodiment shown in FIG. 26, in which a pump casing 14 has two sections having different outer diameters corresponding to respective different diameters of vane pumping section L1 and spiral groove pumping section L2, i.e., groove pumping section L2 has a smaller diameter than vane pumping section L1. That is, pump casing 14 comprises an upper pump casing 14A on the intake side and a lower pump casing 14B below having a smaller diameter. An impact absorbing member 186 is provided between lower inner casing 150 and spiral groove section spacer 151. Lower inner casing 150 is supported at its upper and lower edges of the outer surface by two mechanical bearings 194*a*, 194*b*.

A heat transfer member 202 made of a high thermal conductivity material (such as aluminum alloy or copper etc.) is arranged inside the upper flange of lower inner casing 150, which is in contact with a second heat transfer member 204 attached to upper flange 14*d* of exhaust side pump casing 14B. On the other hand, a cooling pipe 206 is provided in the vicinity of upper flange 14*d* of exhaust side pump casing 14B for flowing cooling water therein. Thus, heat generated by rotor R when it agitates exhaust gas in the downstream area of vane pumping section L1 is transferred to exhaust side pump casing 14B via heat transfer members 202, 204 to be dissipated. Therefore, the generated heat is effectively removed so that a wide operation range (range for gas flow rate and pressure) for the pump is obtainable. Even when rotor R is in an abnormal situation and inner casing 152 is going to rotate, two heat transfer members 202, 204 are separate so as not to interfere with rotation thereby to reduce the generated torque.

On the other hand, a heater 208 for preventing the deposition of exhaust gas components is assembled below spiral groove pumping section spacer 151. By adjusting the temperature by controlling the heater 208, which is directly attached to the area of the spiral groove section spacer of the spiral groove pumping section vulnerable to such deposition, in combination with temperature sensing function, such deposition is effectively prevented. In this embodiment, heater or cooling pipe can be attached or heat transfer members can be incorporated to inner casing 152 or its auxiliary elements so that necessary localized temperature control is provided at desired location of the pump. It can prevent generation of byproduct material within the pump during specific processes thereby to expand the operational range of the pump.

Figure 31:
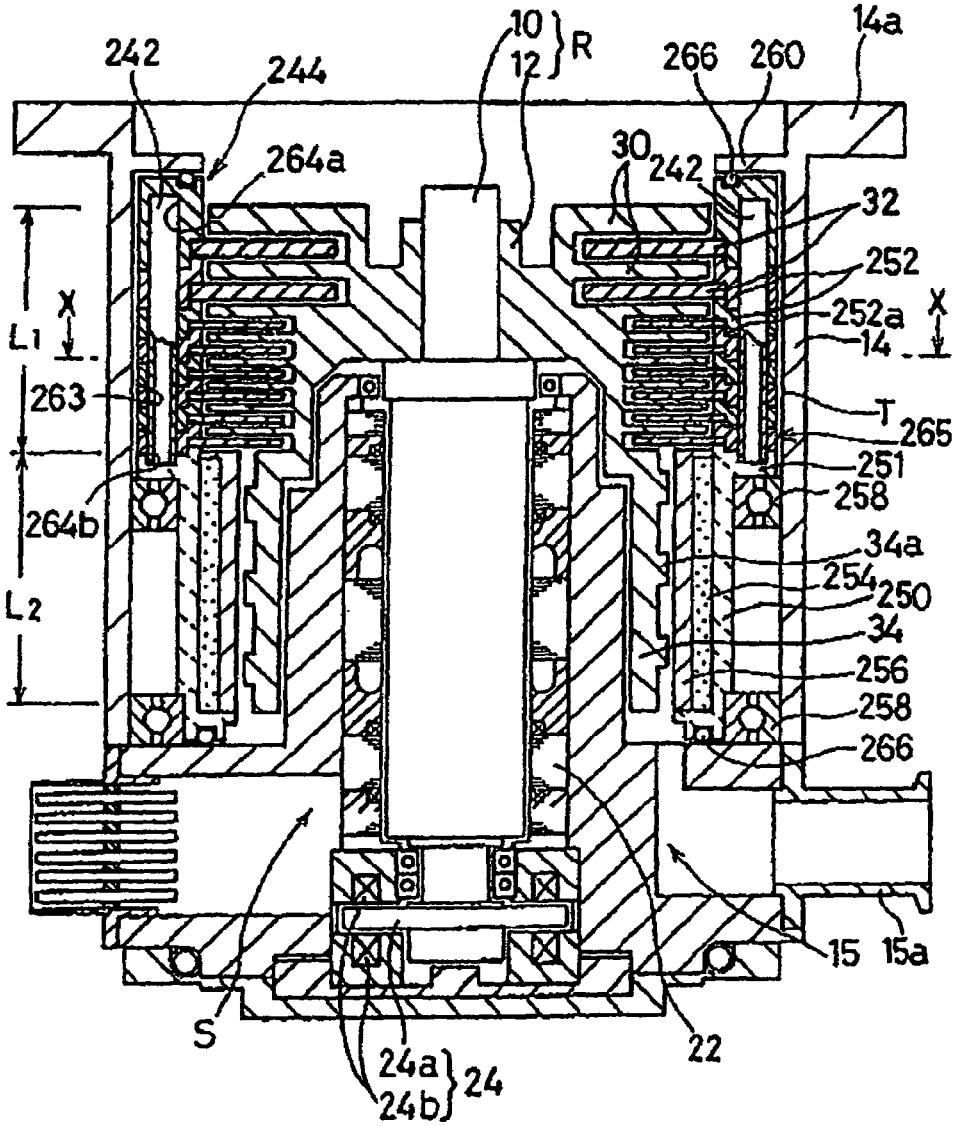
FIG. 31 is a cross sectional view of a turbo-molecular pump of another embodiment according to the present invention.
Figure 32:
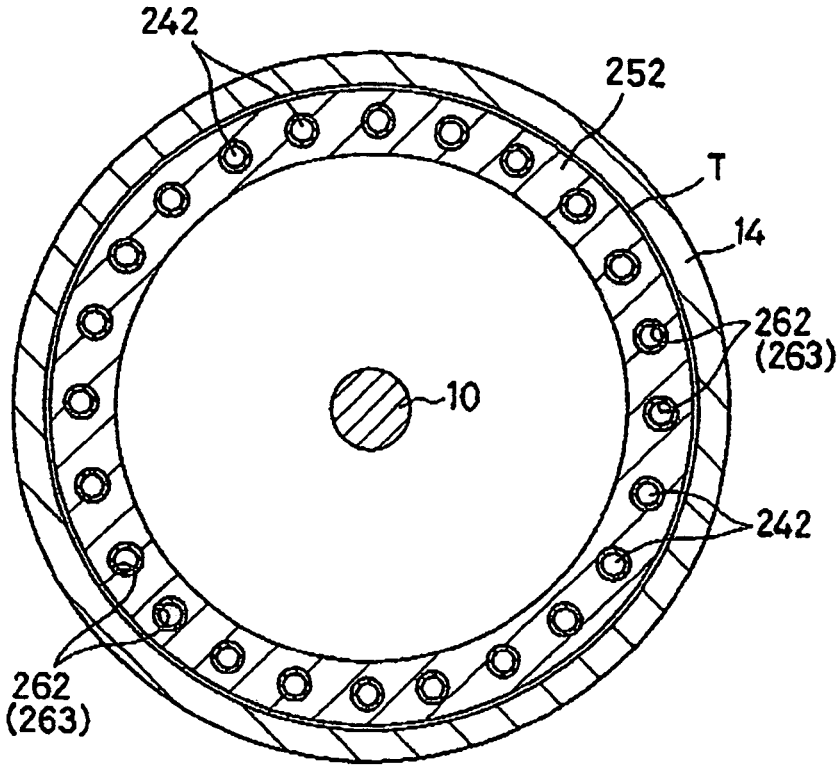
FIG. 32 is a cross sectional view through a plane X—X in FIG. 31.

FIGS. 31 and 32 show a turbo-molecular pump of another embodiment according to the present invention, which differs from the conventional turbo-molecular pump shown in FIG. 37 in that a vane pumping section stator assembly 244, having a stacked configuration comprising stator vane spacers 252 of vane pumping section, is not in a close contact with pump casing 14.

Vane pumping section stator assembly 244 is comprised by a plurality of annular stator vane spacers 252 mutually stacked and holding stator vanes 32 therebetween. Stator vane spacers 252 comprises circumferential step 252*a* for facilitating mutual alignment and preventing mutual displacement. The outer diameter of stator vane spacer 252 is smaller than the inner diameter of pump casing 14 so that a clearance T having several millimeters (3 mm~10 mm) thickness is formed therebetween.

Each of stator vane spacer 252 is formed with apertures 262 (recesses 264*a* on the uppermost stator vane spacer 252), so that axially extending through holes 263 are formed when vane pumping section stator assembly 244 is assembled by stacking stator vane spacers 252. A bar member (reinforcing bar) 242 having almost same length with vane pumping section stator assembly 244 and hollow cylindrical shape is inserted in each of through holes 263 to penetrate stator vane spacers. Bar member 242 may be solid or have any shape, but a hollow pipe shape can provide a light weight while maintaining necessary rigidity and specific energy absorption characteristics. Bar member 242 has almost the same outer diameter as the inner diameter of through holes 263 in this embodiment, but a smaller diameter may be applicable, or, by forming longitudinal grooves on the outer surface, bar member may contact partially with the inner surface of through holes 263.

Bar member 242 should have a mechanical property such that it does not deform during normal operating conditions to maintain the shape of vane pumping section stator assembly 244, while, when an impact torque is loaded due to abnormal contact of rotor R, it absorbs the impact energy through its plastic deformation or fracture. Therefore, material, dimension such as diameter or thickness, shape of bar member 242, or number to be installed in one stator assembly 244 should be determined in consideration of anticipated magnitude of impact. Material such as stainless steel having high toughness and high deformability is suitable. Also, it may be a composite material comprising different materials combined together.

Spiral groove pumping section L2 comprises a spiral groove section 34 of rotor cylinder section 12 and spiral groove section spacer 256 surrounding spiral groove section 34. Spiral groove section spacer 256 is attached to cylindrical lower inner casing 250 via cylindrical impact absorbing member 254 made of a material such as relatively soft metal, high polymer or composite material thereof. Lower inner casing 250 is slidably mounted on pump casing 14 by being supported by two vertically spaced mechanical bearings (friction reducing mechanism) 258.

A flange 251 is outwardly protruding from the upper portion of lower inner casing 250, and a recess 264*b* having the same diameter as and corresponding locations to through holes 263 are formed on the upper surface of flange 250. The tips of bar member 242 protruding from the lower end of through holes 263 are respectively inserted into recesses 264*b* so that vane pumping section stator assembly 244 and lower inner casing 250 are connected together to restrict relative circumferential move, thereby to construct a pump section stator assembly 265 separate from pump casing 14.

These two bearings 258 are widely distant to each other in an axial direction so that supporting performance is enhanced for holding pump section stator assembly 265, thus, it would not tilt even a large radial impact force is loaded when rotor R is fractured. In order to establish this, one bearing may be located adjacent the intake port of vane pumping section L1, that is, on the outer surface of vane pumping section stator assembly 244, and the other adjacent the exhaust port of spiral groove pumping section L2. Also, more than three bearings may be provided along the axial direction. In this embodiment, since the spaces for installing bearings 258 is defined by taking advantage that spiral groove pumping section L2 has smaller diameter than vane pumping section, it is not necessary to increase the overall diameter of the pump thereby to maintain its compactness.

As for mechanical bearing 258, a deep groove ball bearing or a roller bearing can be used for exclusively receiving the radial direction load, but angular bearings can be used in a single or combined arrangement to receive axial load potentially loaded when rotor R is fractured. It is preferable, in case of handling corrosive gases, to manufacture the bearing from corrosion resistant material such as stainless steel, or to apply surface treatment such as nickel coating to a less corrosion resistant material.

Assembling such pumping section stator assembly 265 is basically similar to that of conventional one shown in FIG. 37. That is, a stator vane 32 comprising two half sections is arranged on the upper surface of lower inner casing 250 from both sides, then stator vane spacer 252 is mounted by fitting thereon, further, a stator vane 32 is built in from both sides of rotor vanes 30, and stator vane spacer 252 is mounted by fitting thereon. This assembling step is repeated to complete the stacked assembly of stator vanes 32 surrounding rotor R. Pumping section stator assembly 265 is inserted into pump casing 14 from the bottom side thereof, which is then covered with base section 15. Thus, pumping section stator assembly 265 is fixed between suppressing member 260 protruding from upper inner surface and base section 15.

In this embodiment, seal members 266 are provided between the uppermost stator vane spacer 252 and suppressing member 260 of pump casing 14, or lower inner casing 250 and stator for preventing the exhaust gas from reversely flowing from exhaust side to intake side or protecting mechanical bearings 258. Seal member 266 is, for instance, an O-ring or a sheet formed from material such as fluoro rubber.

In this embodiment, since vane pumping section stator assembly 244 (stator vane spacers 252 and stator vanes 32) and lower inner casing 250 for constructing pumping section stator assembly 265 are loaded with impact in case of rotor fracture, these elements should be made of a material with high strength and high elongation such as stainless steel or aluminum alloys. Especially aluminum alloys are effective in consideration of cost saving and weight reduction of the pump. Also, use of aluminum alloys having high specific strength for pump casing 14 is effective for weight reduction of the pump.

The turbo-molecular pump is operated by connecting flange 14*a* to a vacuum process chamber or conduits thereto, for example, and when rotor R is fractured or under abnormal rotation, rotor R will contact with stator vanes 32 or spiral vane section spacer 256 and its rotational torque will be transmitted to vane pumping section stator assembly 244 or lower inner casing 250, i.e., pumping section stator assembly 265.

Here, in vane pumping section L1, impact is loaded to some of stator vanes 252 in a peripheral direction which is then loaded to bar members 242 to deform or fracture it. Since bar members 242 plastically deform or fracture to absorb the impact energy thereby to prevent impact from being transmitted to pump casing 14. Since clearance T is provided between vane pumping section stator assembly 244 and pump casing 14, even if vane pumping section stator assembly 244 has deformed to some degree, the impact would not be transmitted directly to pump casing 14. Therefore, fracturing of pump casing 14 itself or connections between pump casing 14 and external devices will be prevented.

Concurrently with, or before or after this deformation of bar members 242, pumping section stator assembly 265 is dragged to rotate by rotating rotor R. Pumping section stator assembly 265 is rather weakly engaged to pump casing 14 because it is held only through seal member 266 from top and bottom ends. Also, mechanical bearings 258 are intervened between pumping section stator assembly 265 and pump casing 14. Thus, pumping section stator assembly 265 is easily dragged to rotate by rotor R thereby to further absorb the impact. Here, clearance T is provided between stator vane spacers 252 and pump casing 14, impact would not be transmitted directly to pump casing 14 even when pumping section stator assembly 265 is dragged to rotate. In spiral groove pumping section L2, impact force transmitted from rotor R to lower inner casing 250 is moderated by impact absorbing member 254. Deformation and dragging of pumping section stator assembly 265 do not always happen concurrently, and only one of them may happen depends on cases, which can be set according to assumed magnitude of potential impact.

Figure 33:
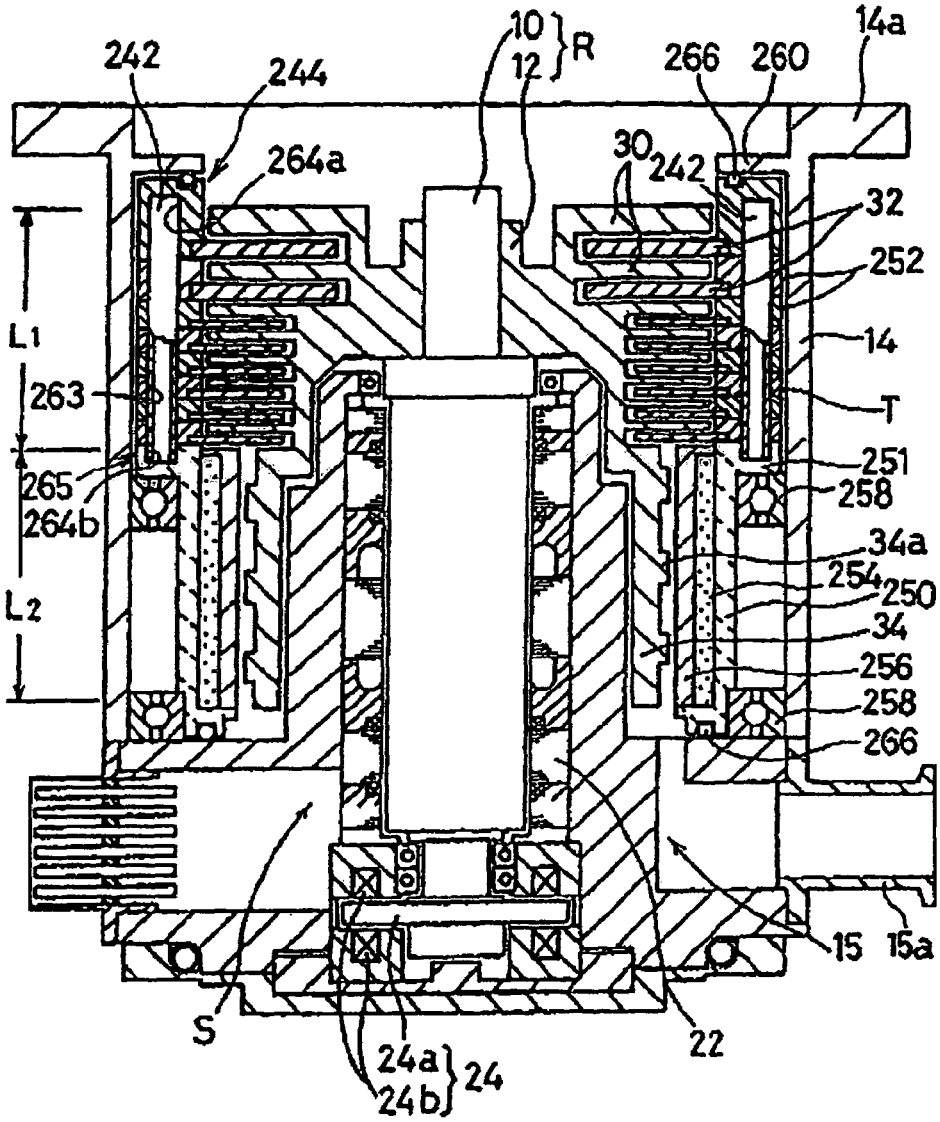
FIG. 33 is a cross sectional view of a turbo-molecular pump of another embodiment according to the present invention.

FIG. 33 shows another embodiment according to the present invention, in which stator vane spacers 252 do not comprise the step on their upper or lower surface for fitting into neighboring stator vane spacer. Thus, mutual positioning of stator vane spacers 252 in a radial direction is performed only by bar members 242, providing weaker constraint therebetween. Other construction is same as the previous embodiment.

In this embodiment, stator vane 32 can slide in a radial direction as well as peripheral direction when fragments of rotor R collide with stator vane spacers 252. Thus, bar members 242 deform or fracture in both radial and peripheral directions thereby to absorb a larger amount of impact energy. Since stator vane spacers 252 are not provided with fitting steps requiring a high precision machining, they can be easily manufactured to raise productivity.

Figure 34:
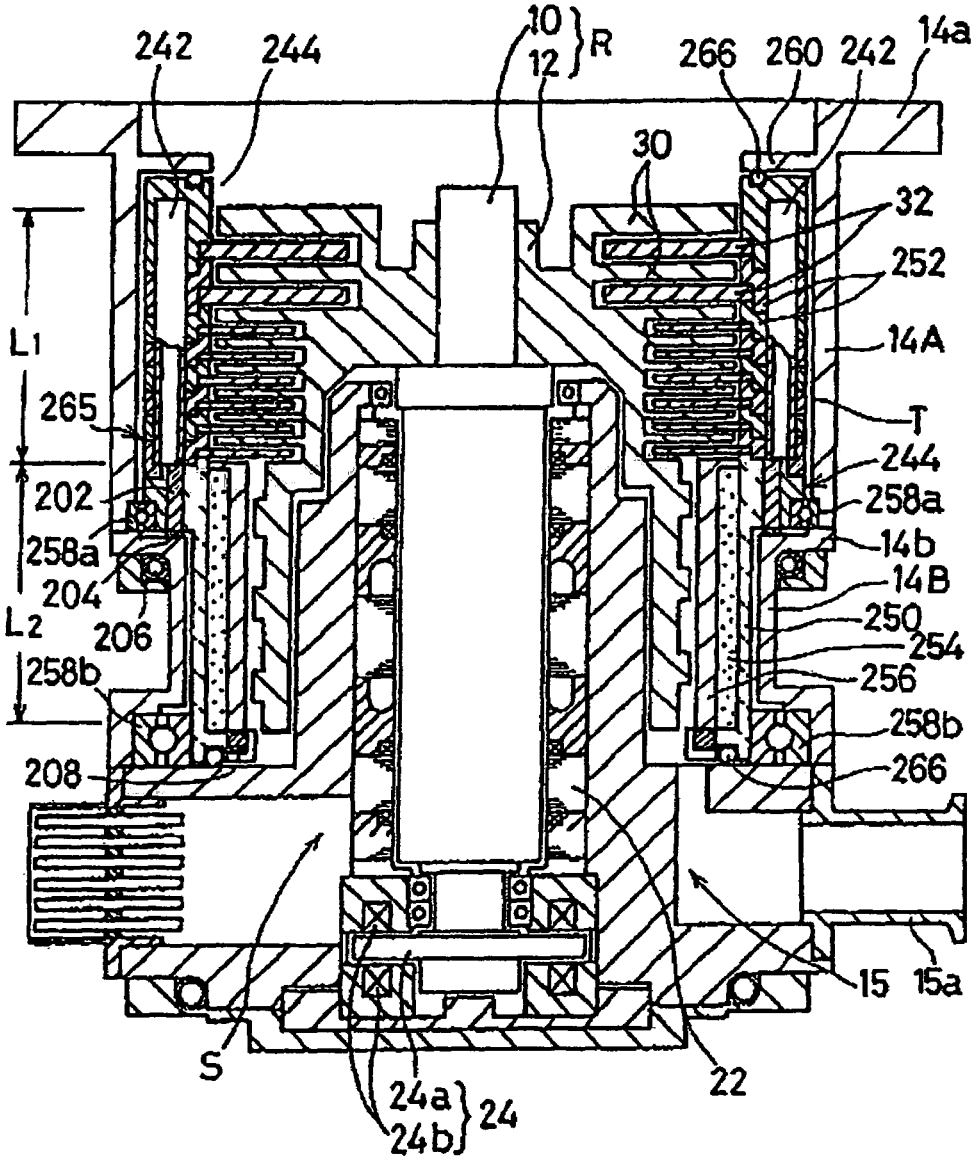
FIG. 34 is a cross sectional view of a turbo-molecular pump of another embodiment according to the present invention.

FIG. 34 shows another embodiment according to the present invention, in which, as similar to the embodiment shown in FIGS. 29 and 30, necessary temperature control is provided at desired location of the pump thereby to prevent generation of byproduct within the pump during given process to enlarge the operational range.

Figure 35:
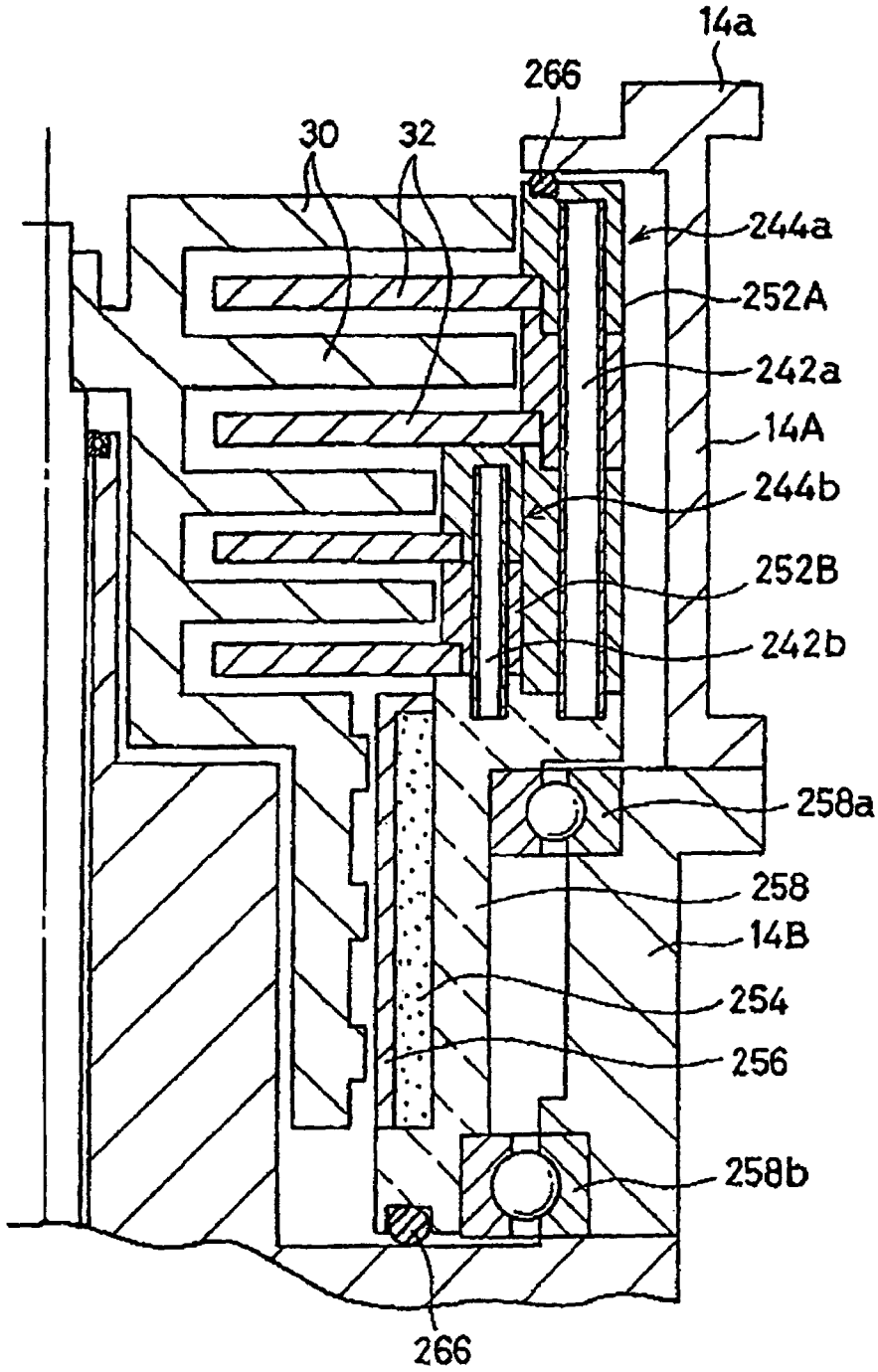
FIG. 35 is a partial cross sectional view of a turbo-molecular pump of another embodiment according to the present invention.

FIG. 35 shows a further embodiment according to the present invention where stator assembly comprises a double cylinder construction in the exhaust side corresponding to configuration that the rotor vanes in the exhaust side have a smaller diameter than those in the intake side in vane pumping section L1. In the drawing, a detailed illustration for a magnetic bearing and motor section for supporting and rotating the rotor is omitted. Vane pumping section stator assembly 244*a*, 244*b* are comprised by outer and inner stator vane spacers 252A, 252B and bar members 242 respectively penetrating stator vane spacers 244*a*, 244*b*. It is necessary to construct inner stator vane spacers 252B, likewise outer stator vane spacers 252A, from plural segmentations in order to house stator vanes 32 therein. Assembly of turbo-molecular pump according to this embodiment is performed by, firstly, forming vane pumping section stator assembly 244*b*, and then assembling it inside outer vane pumping section stator assembly 244*a* formed from outer stator vane spacers 252A. The upper surface of the flange of lower inner casing 250 is formed with recesses 264*b* for receiving lower edges of outer and inner bar members 242*a*, 242*b*.

By such configuration, surface area of rotor vanes for agitating the gas at the exhaust side of the vane pumping section is reduced thereby to suppress the heat generation due to the gas agitation. Also, such partial dual cylinder construction will provide a higher rigidity and higher impact absorbing ability to vane pumping section stator assembly 244.

Figure 36:
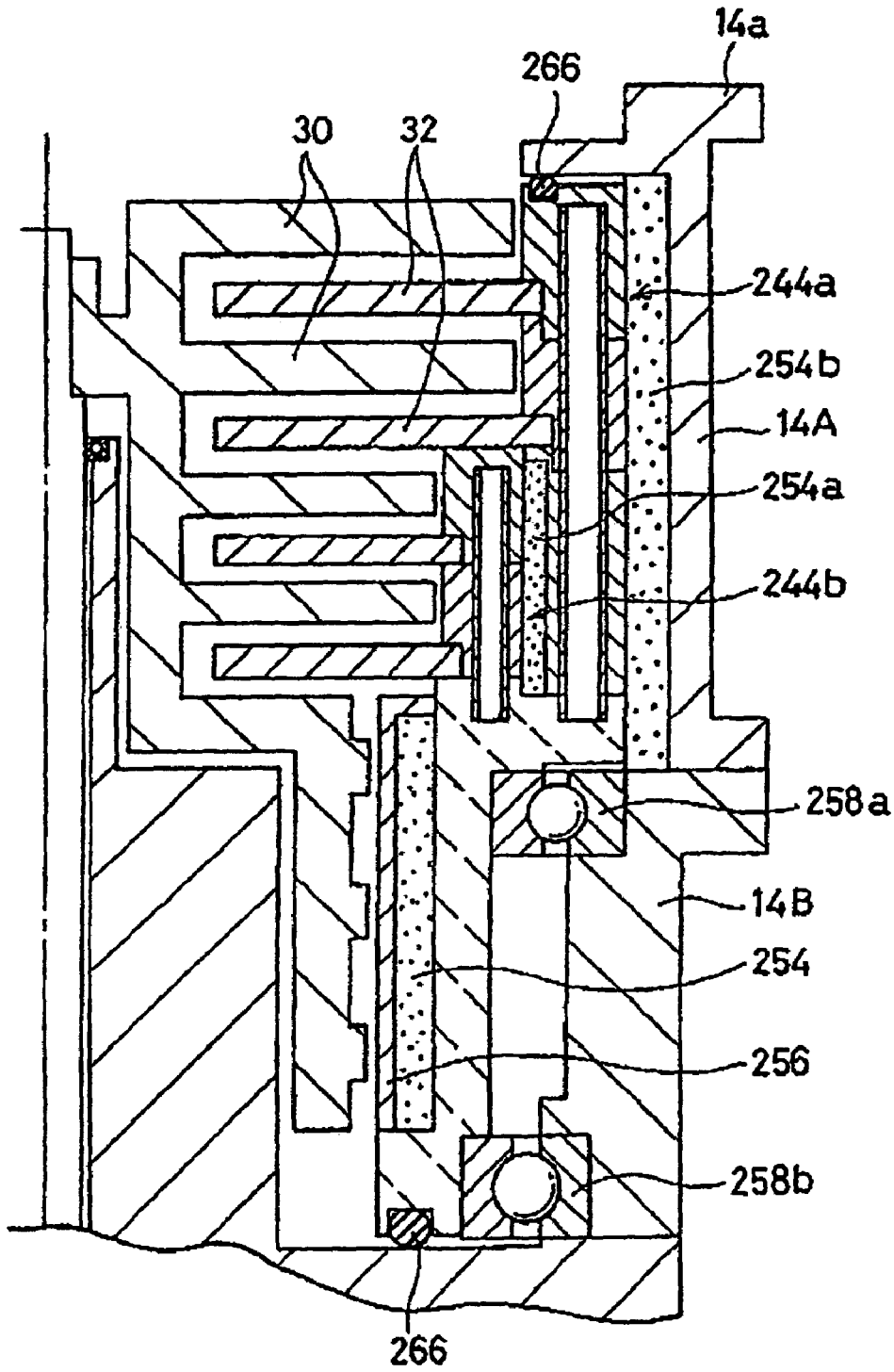
FIG. 36 is a partial cross sectional view of a turbo-molecular pump of another embodiment according to the present invention.

FIG. 36 shows a modified embodiment of the one shown in FIG. 35, in which, impact absorbing members 254*a*, 254*b* are provided between vane pumping section stator assembly 244*a*, 244*b* or vane pumping section stator assembly 244*b* and pump casing 14. In this drawing also, a detailed illustration for a magnetic bearing and motor section for supporting and rotating the rotor is omitted. It is preferable to use a pipe element made of energy absorbable material, which deforms when abnormal torque is generated, formed in a coil shape or arranged into a cylinder shape. By such configuration, overall energy absorbing ability is further enhanced. It is also preferable to use a base material or a surface layer having a good slidability for impact absorbing member 254*b* installed between pumping section stator assembly 265 and pump casing 14.

It should be noted that, in the foregoing embodiments, the invention was represented by wide-range type turbo-molecular pumps having a vane pumping section $L_1$ and groove pumping section $L_2$. However, depending on the nature of the processing facilities under consideration, the invention can be applied to those pumps having only vane pumping section $L_1$ or only groove pumping section $L_2$. For those wide-range pumps having both pumping sections $L_1$ and $L_2$, it is understandable that the invention can be provided only on one of the two pumping sections. It is equally understandable that any of the embodied structures can be combinedly used.

What is claimed is:

1. A turbo-molecular pump comprising:

a rotor;

a stator surrounding said rotor;

a casing portion housing said stator and said rotor therein;

a vane pumping section and/or a groove pumping section comprised by said stator and said rotor; and a slide facilitating member for facilitating said stator to slide in a circumferential direction relative to said casing portion, wherein a clearance is formed between said stator and said casing portion, so that, when an abnormal torque is applied from said rotor to said stator, at least a part of said stator is allowed to move radially into said clearance.

2. A turbo-molecular pump according to claim 1, wherein said slide facilitating member is a low friction member provided between said stator and said casing portion.

3. A turbo-molecular pump according to claim 1, wherein said slide facilitating member is a support structure for rotatably supporting said stator.

4. A turbo-molecular pump according to claim 1, wherein an impact absorbing member is provided between said stator and said casing portion.

5. A turbo-molecular pump according to claim 1, further comprising an impact absorbing structure provided in said casing portion.

6. A turbo-molecular pump according to claim 5, wherein said impact absorbing structure comprises an inner casing surrounding said vane pumping section and/or said groove pumping section.

7. A turbo-molecular pump according to claim 5, wherein said impact absorbing structure comprises a friction reducing mechanism provided between an inner casing surrounding said vane pumping section and/or said groove pumping section, and said stator or said casing portion.

8. A turbo-molecular pump according to claim 5, wherein said impact absorbing structure comprises an impact absorbing member provided between an inner casing surrounding said vane pumping section and/or said groove pumping section, and said stator or said casing portion.

9. A turbo-molecular pump according to claim 1, further comprising an inner casing which surrounds said stator.

10. A turbo-molecular pump according to claim 9, wherein a friction reducing mechanism is provided between said inner casing, and said stator or said casing portion.

11. A turbo-molecular pump according to claim 1, further comprising a temperature adjusting mechanism for directly or indirectly heating or cooling said stator.

12. A turbo-molecular pump according to claim 11, wherein an inner casing surrounds said stator, and said temperature adjusting mechanism is provided on said inner casing.

13. A turbo-molecular pump according to claim 1, further comprising:

a sealing portion provided between a portion of said stator which is caused to be rotated with a rotating element by said abnormal torque, and a portion of said casing portion which is not rotated with the rotating element by said abnormal torque and is stationary.

14. A turbo-molecular pump according to claim 1, wherein an inner casing surrounds said stator, and said clearance is provided between said inner casing and said casing portion.

15. A turbo-molecular pump according to claim 14, wherein said inner casing is fixed by fitting a part of an inner surface or an outer surface of said inner casing to a cylindrical portion of said stator or to said casing portion.

16. A turbo-molecular pump according to claim 14, wherein said inner casing and/or said casing portion is comprised of a high thermal conductivity material.

17. A turbo-molecular pump according to claim 1, wherein said vane pumping section and/or said groove pumping section stator is attached to said casing portion by way of a friction reducing mechanism.

18. A turbo-molecular pump according to claim 1, wherein said vane pumping section is comprised by said stator and said rotor, and a temperature adjusting mechanism is provided between a downstream side of said vane pumping section and an upstream side of an exhaust port of said turbo-molecular pump.

19. A turbo-molecular pump according to claim 1, wherein a sealing portion is provided between said stator of said vane pumping section and said casing portion.

20. A turbo-molecular pump according to claim 1, wherein a sealing portion is provided between said stator of said groove pumping section and said casing portion.

21. A turbo-molecular pump comprising:

a rotor;

a stator surrounding said rotor;

a casing portion housing said stator and said rotor therein;

a vane pumping section and/or a groove pumping section comprised by said stator and said rotor; and a slide facilitating member for facilitating said stator to slide in a circumferential direction relative to said casing portion, wherein a clearance is formed between said stator and said casing portion, so that, when an abnormal torque is applied from said rotor to said stator, at least a part of said stator is allowed to rotate.

22. A turbo-molecular pump according to claim 21, wherein said slide facilitating member is a low friction member provided between said stator and said casing portion.

23. A turbo-molecular pump according to claim 21, wherein said slide facilitating member is a support structure for rotatably supporting said stator.

24. A turbo-molecular pump according to claim 21, wherein an impact absorbing member is provided between said stator and said casing portion.

25. A turbo-molecular according to claim 21, wherein said stator has an impact absorbing structure.

26. A turbo-molecular pump according to claim 24, wherein said impact absorbing structure comprises an inner casing surrounding said vane pumping section and/or said groove pumping section.

27. A turbo-molecular pump according to claim 26, wherein said impact absorbing structure comprises a friction reducing mechanism provided between said inner casing, and said stator or said casing portion.

28. A turbo-molecular pump according to claim 26, wherein said impact absorbing structure comprises an impact absorbing member provided between said inner casing, and said stator or said casing portion.

29. A turbo-molecular pump according to claim 21, further comprising an inner casing which surrounds said stator.

30. A turbo-molecular pump according to claim 29, wherein a friction reducing mechanism is provided between said inner casing, and said stator or said casing portion.

31. A turbo-molecular pump according to claim 21, further comprising a temperature adjusting mechanism for directly heating or cooling said stator.

32. A turbo-molecular pump according to claim 31, wherein an inner casing surrounds said stator, and said temperature adjusting mechanism is provided on said inner casing.

33. A turbo-molecular pump according to claim 21, further comprising:

a sealing portion provided between a portion of said stator which is caused to be rotated with a rotating element by said abnormal torque, and a portion of said casing portion which is not rotated with the rotating element by said abnormal torque and is stationary.

34. A turbo-molecular pump according to claim 21, wherein an inner casing surrounds said stator, and said clearance is provided between said inner casing and said casing portion.

35. A turbo-molecular pump according to claim 34, wherein said inner casing is fixed by fitting a part of an inner surface or an outer of said inner casing to a cylindrical portion of said stator or to said casing portion.

36. A turbo-molecular pump according to claim 34, wherein said inner casing and/or said casing portion is comprised of a high thermal conductivity material.

37. A turbo-molecular pump according to claim 21, wherein said vane pumping section and/or said groove pumping section stator is attached to said casing portion by way of a friction reducing mechanism.

38. A turbo-molecular pump according to claim 21, wherein said vane pumping section is comprised by said stator and said rotor, and a temperature adjusting mechanism is provided between a downstream side of said vane pumping section and an upstream side of an exhaust port of said turbo-molecular pump.

39. A turbo-molecular pump according to claim 21, wherein a sealing portion is provided between said stator of said vane pumping section and said casing portion.

40. A turbo-molecular pump according to claim 21, wherein a sealing portion is provided between said stator of said groove pumping section and said casing portion.

41. A turbo-molecular pump comprising:

a casing portion housing a stator and a rotor therein;

a vane pumping section and/or a groove pumping section comprised by said stator and said rotor;

an inner casing surrounding said vane pumping section and/or said groove pumping section; and a temperature adjusting mechanism provided inside said inner casing;

wherein said temperature adjusting mechanism is attached to a spiral groove pumping section spacer.

42. A turbo-molecular pump comprising:

a casing portion housing a stator and a rotor therein, said stator surrounding said rotor;

a vane pumping section and/or a groove pumping section comprised by said stator and said rotor;

an inner casing portion surrounding said stator;

a clearance provided between said inner casing portion and said casing portion; and a sealing portion provided between a portion of said inner casing portion or said stator which is caused to be rotated with a rotating element by an abnormal torque which is applied from said rotor to said stator, and said casing portion which is not rotated with the rotating element by said abnormal torque and is stationary.

43. A turbo-molecular pump according to claim 42, wherein said sealing portion is pressed in an axial direction of a main shaft.

44. A turbo-molecular pump comprising:

a casing portion housing a stator and a rotor therein, said stator surrounding said rotor;

a vane pumping section and/or a groove pumping section comprised by said stator and said rotor;

a sealing portion provided between a portion of said stator which is caused to be rotated with a rotating element by an abnormal torque which is applied from said rotor to said stator, and a portion of said casing portion which is not rotated with the rotating element by said abnormal torque and is stationary; and a slide facilitating member for facilitating said stator to slide in a circumferential direction relative to said casing portion.

45. A turbo-molecular pump according to claim 44, wherein said sealing portion is pressed in an axial direction of a main shaft.

46. A turbo-molecular pump comprising:

a casing portion housing a stator and a rotor therein;

a vane pumping section and a groove pumping section comprised by said stator and said rotor; and a cooling device provided between a downstream side of said vane pumping section and an upstream side of said groove pumping section.

47. A turbo-molecular pump according to claim 46, wherein another cooling device is provided at a downstream side of said cooling device.

48. A turbo-molecular pump comprising:

a casing portion housing a stator and a rotor therein;

a vane pumping section and a groove pumping section comprised by said stator and said rotor; and a cooling device provided on said casing portion at a position corresponding to said groove pumping section.

49. A turbo-molecular pump according to claim 48, wherein said cooling device cools said stator and/or rotor of said vane pumping section.

50. A turbo-molecular pump according to claim 48, wherein a heat transfer path is provided between said cooling device and said stator of said vane pumping section.

51. A turbo-molecular pump according to claim 48, wherein another cooling device is provided at a downstream side of said cooling device.

52. A turbo-molecular pump comprising:

a casing portion housing a stator and rotor therein;

a vane pumping section and groove pumping section comprised by said stator and said rotor;

a heating source provided at a lower portion of said stator of said groove pumping section; and a cooling device provided between a downstream side of said vane pumping section and an upstream side of said groove pumping section.

53. A turbo-molecular pump according to claim 52, further comprising an inner casing surrounding said stator and/or said rotor of said rotor of said vane pumping section and/or said groove pumping section.

54. A turbo-molecular pump according to claim 53, wherein a heat transfer path is provided between said inner casing and said casing portion.

55. A turbo-molecular pump according to claim 53, wherein a heat transfer path is provided between said inner casing and a stator vane spacer.

56. A turbo-molecular pump comprising:

a casing portion housing a stator and a rotor therein; and a vane pumping section and/or a groove pumping section comprised by said stator and said rotor;

wherein said stator of said vane pumping section and/or said groove pumping section is rotatably provided with respect to said casing portion; and an impact absorbing structure is provided at a portion close to an inlet of said casing portion.

57. A turbo-molecular pump according to claim 56, wherein said impact absorbing structure comprises a ring body, an attachment ring, and a plurality of stay members for coupling said ring body and said attachment ring concentrically.

58. A turbo-molecular pump comprising:

a casing portion housing a stator and a rotor therein;

a vane pumping section and/or a groove pumping section comprised by said stator and said rotor; and a cooling device provided at a lower end portion of said stator of said groove pumping section.

59. A turbo-molecular pump comprising:

a casing portion housing a stator and a rotor therein;

a vane pumping section and/or a groove pumping section comprised by said stator and said rotor; and a heating source directly attached to a lower end portion of said stator of said groove pumping section at a position lower than a lower end of said rotor of said groove pumping section, wherein the heat generating portion of said heating source does not protrude beyond the confines of said casing portion.

60. A turbo-molecular pump comprising:

a casing portion housing a stator and a rotor therein;

a vane pumping section and/or a groove pumping section comprised by said stator and said rotor; and a heating source directly attached to the lowermost end surface of said stator of said groove pumping section, wherein the heat generating portion of said heating source does not protrude beyond the confines of said casing portion.

61. A turbo-molecular pump comprising:

a casing portion housing a stator and a rotor therein;

a vane pumping section and/or a groove pumping section comprised by said stator and said rotor;

a heating source provided on a portion of said stator which is caused to be rotated with a rotating element by an abnormal torque which is applied from said rotor to said stator; and a slide facilitating member for facilitating said stator to slide in a circumferential direction relative to said casing portion.

* * * * *

UNITED STATES PATENT AND TRADEMARK OFFICE

CERTIFICATE OF CORRECTION

PATENT NO. : 6,926,493 B1
DATED : August 9, 2005
INVENTOR(S) : Matsutaro Miyamoto et al.

It is certified that error appears in the above-identified patent and that said Letters Patent is hereby corrected as shown below:

Title page,
Item [*] Notice, add -- This patent is subject to a terminal disclaimer. --.

Signed and Sealed this

Twenty-seventh Day of December, 2005

JON W. DUDAS
*Director of the United States Patent and Trademark Office*